US008455818B2

(12) United States Patent
Coon et al.

(10) Patent No.: US 8,455,818 B2
(45) Date of Patent: Jun. 4, 2013

(54) MASS SPECTROMETRY DATA ACQUISITION MODE FOR OBTAINING MORE RELIABLE PROTEIN QUANTITATION

(75) Inventors: Joshua J. Coon, Middleton, WI (US); Douglas H. Phanstiel, Los Altos, CA (US); Craig D. Wenger, Santa Clara, CA (US)

(73) Assignee: Wisconsin Alumni Research Foundation, Madison, WI (US)

( * ) Notice: Subject to any disclaimer, the term of this patent is extended or adjusted under 35 U.S.C. 154(b) by 41 days.

(21) Appl. No.: 13/086,638

(22) Filed: Apr. 14, 2011

(65) Prior Publication Data

US 2011/0297823 A1 Dec. 8, 2011

Related U.S. Application Data

(60) Provisional application No. 61/324,065, filed on Apr. 14, 2010.

(51) Int. Cl.
*H01J 49/00* (2006.01)
*H01J 49/06* (2006.01)

(52) U.S. Cl.
USPC ..... 250/290; 250/281; 250/282; 250/284; 250/286; 250/288

(58) Field of Classification Search
USPC ..... 250/281, 282, 284, 286, 288, 290
See application file for complete search history.

(56) References Cited

U.S. PATENT DOCUMENTS 6,057,543 A * 5/2000 Vestal et al. ..... 250/282
6,281,493 B1 * 8/2001 Vestal et al. ..... 250/287
6,489,610 B1 * 12/2002 Barofsky et al. ..... 250/287
6,541,765 B1 * 4/2003 Vestal ..... 250/282
6,570,153 B1 * 5/2003 Li et al. ..... 250/292
6,586,727 B2 7/2003 Bateman et al.
6,670,194 B1 12/2003 Aebersold et al.
6,940,065 B2 9/2005 Graber et al.
7,195,751 B2 3/2007 Pappin et al.
7,223,966 B2 * 5/2007 Weiss et al. ..... 250/287
7,534,622 B2 * 5/2009 Hunt et al. ..... 436/173

(Continued)

FOREIGN PATENT DOCUMENTS

WO WO 03/025576 3/2003
WO WO 2004/086050 10/2004

(Continued)

OTHER PUBLICATIONS

Becker, K.A., Stein, J.L., Lian, J.B., Van Wijnen, A.J. & Stein, G.S. (2006), "Establishment of Histone Gene Regulation and Cell Cycle Checkpoint Control in Human Empryonic Stem Cells," J. Cell. Physiol. 210, 517-526.

(Continued)

*Primary Examiner* — David A Vanore
(74) *Attorney, Agent, or Firm* — Lathrop & Gage LLP

(57) ABSTRACT

Described herein are methods and systems which enable a unique platform for analyte quantitation. The methods and systems relate to determining the amount of interference in a precursor ion isolation window resulting from an impurity. Once the level of impurity is determined, several methods can be employed to reduce the amount of interference in a subsequent MS/MS spectrum. The methods and systems described herein enable increased quantitation accuracy while maintaining high levels of throughput.

26 Claims, 10 Drawing Sheets

U.S. PATENT DOCUMENTS

| | | | | |
|---|---|---|---|---|
| 7,558,682 | B2 | 7/2009 | Yamamoto | |
| 7,633,059 | B2 * | 12/2009 | Russ et al. | 250/281 |
| 7,749,769 | B2 * | 7/2010 | Hunt et al. | 436/173 |
| 7,755,036 | B2 * | 7/2010 | Satoh | 250/287 |
| 7,928,361 | B1 * | 4/2011 | Whitehouse et al. | 250/281 |
| 7,932,491 | B2 * | 4/2011 | Vestal | 250/287 |
| 7,982,070 | B2 * | 7/2011 | Smith et al. | 564/291 |
| 8,071,938 | B2 * | 12/2011 | Guharay | 250/287 |
| 2005/0147982 | A1 | 7/2005 | Pappin et al. | |
| 2005/0148087 | A1 | 7/2005 | Pappin et al. | |
| 2005/0153456 | A1 | 7/2005 | Pappin | |
| 2006/0105416 | A1 | 5/2006 | Pappin et al. | |
| 2006/0115871 | A1 | 6/2006 | Bruce et al. | |
| 2006/0172319 | A1 | 8/2006 | Yan et al. | |
| 2007/0054345 | A1 | 3/2007 | Hunter | |
| 2007/0207555 | A1 | 9/2007 | Guerra et al. | |
| 2007/0218560 | A1 | 9/2007 | Pillai et al. | |
| 2008/0070314 | A1 | 3/2008 | Geromanos et al. | |
| 2008/0087814 | A1 * | 4/2008 | Loucks | 250/287 |
| 2008/0113441 | A1 | 5/2008 | Orlando et al. | |
| 2008/0149825 | A1 | 6/2008 | Kozlovski et al. | |
| 2008/0206737 | A1 | 8/2008 | Hunter | |
| 2008/0272292 | A1 | 11/2008 | Geromanos et al. | |
| 2009/0065686 | A1 | 3/2009 | Shilov et al. | |
| 2009/0194682 | A1 | 8/2009 | Zhang et al. | |
| 2009/0283673 | A1 | 11/2009 | Shilov et al. | |
| 2010/0227352 | A1 * | 9/2010 | Hunter | 435/23 |
| 2011/0297823 | A1 * | 12/2011 | Coon et al. | 250/282 |
| 2012/0022230 | A1 * | 1/2012 | Smith et al. | 530/345 |
| 2012/0091330 | A1 * | 4/2012 | Coon et al. | 250/282 |

FOREIGN PATENT DOCUMENTS

| | | |
|---|---|---|
| WO | WO 2006/084130 | 8/2006 |
| WO | WO 2007/076606 | 7/2007 |
| WO | WO 2008/053399 | 5/2008 |
| WO | WO 2008/111911 | 9/2008 |
| WO | WO 2008/151207 | 12/2008 |

OTHER PUBLICATIONS

Choe, L. et al. (2007), "8-flex quantitation of changes in cerebrospinal fluid protein expression in subject undergoing intravenous immunoglobulin treatment for Alzheimer's disease," Proteomics 7, 3651-3660.

de Godoy, L.M.F. et al. (2008), "Comprehensive mass-spectrometry-based proteome quantification of haploid versus yeast," Nature 455, 1251-1255.

Elias, J.E. & Gygi, S.P. (2007), "Target-decoy search strategy for increased confidence in large-scale protein identifications by mass spectrometry," Nat. Methods vol. 4, No. 3, pp. 207-214.

Geer, L. Y.; Markey, S. P.; Kowalak, J. A.; Wagner, L.; Xu, M.; Maynard, D. M.; Yang, X. Y.; Shi, W. Y.; Bryant, S. H. (2004), "Open mass spectrometry search algorithm," Journal of Proteome Research 2004, 3, (5), 958-964.

Good, D. M.; Wenger, C. D.; McAlister, G. C.; Bai, D. L.; Hunt, D. F.; Coon, J. J., (2009), "Post-Acquisition ETD Spectral Processing for Increased Peptide Identifications," Journal of the American Society for Mass Spectrometry, 20, (8), 1435-1440.

Gygi et al. (1999), "Quantitative analysis of complex protein mixtures using isotope-coded affinity tags," Nature Biotechnology vol. 17 Oct. 1999.

Hsieh, E. J.; Hoopmann, M. R.; Maclean, B.; Maccoss, M. J. (2009), "Comparison of Database Search Strategies for High Precursor Mass Accuracy MS/MS Data," Journal of Proteome Research 2010, 9, 1138-1143.

Jiang, H. & English, A.M. (2002), "Quantitative Analysis of the Yeast Proteome by Incorporation of Isotopically Labeled Leucine," J. Proteome Res. 2002, 1, 345-350.

Karp, N.A. et al. (2010), "Addressing Accuracy and Precision Issues in iTRAQ Quantitation," Mol. Cell. Proteomics 9.9, 1885-1897.

Kersey, P. J.; Duarte, J.; Williams, A.; Karavidopoulou, Y.; Birney, E.; Apweiler, R.(2004), "The International Protein Index: An integrated database for proteomics experiments," Proteomics 2004, 4, 1985-1988.

Lu, R. et al. (2009), "Systems-level dynamic analyses of fate change in murine embryonic stem cells," Nature 462, Nov. 19, 2009, 358-364.

Ludwig, T. E.; Bergendahl, V.; Levenstein, M. E.; Yu, J. Y.; Probasco, M. D.; Thomson, J. A., (2006), "Feeder-independent culture of human embryonic stem cells," Nature Methods 2006, 3, (8), 637-646.

Martin, S.E., Shabanowitz, J., Hunt, D.F. & Marto, J.A. (2000), "Subfemtomole MS and MS/MS Peptide Sequence Analysis Using Nano-HPLC Micro-ESI Fourier Transform Ion Cyclotron Resonance Mass Spectrometry," Anal. Chem. 2000, 72, 4266-4274.

McAlister, G. C.; Phanstiel, D.; Wenger, C. D.; Lee, M. V.; Coon, J. J. (2009), "Analysis of Tandem Mass Spectra by FTMS for Improved Large-Scale Proteomics with Superior Protein Quantification," Analytical Chemistry, 2010, 82, (1), 316-322 (Publication Date (Web): Nov. 25, 2009).

McClatchy et al. (2007), "$^{15}$N Metabolic Labeling of Mammalian Tissue with Slow Protein Turnover," Journal of Proteome Research 2007, 6, 2005-2010.

Nesvizhskii, A. I.; Aebersold, R., (2005), "Interpretation of shotgun proteomic data—The protein inference problem," Molecular & Cellular Proteomics, 4, (10), 1419-1440.

Olsen, J.V. et al. (2010), "Quantitative Phosphoproteomics Reveals Widespread Full Phosphorylation Site Occupancy During Mitosis," Sci. Signal. Jan. 12, 2010, vol. 3, Issue 104 ra3.

Ong, S.E. & Mann, M. (2005), "Mass spectrometry-based proteomics turns quantitative," Nat. Chem. Biol. vol. 1, No. 5, pp. 252-262.

Ong et al.(2002), "Stable Isotope Labeling by Amino Acids in Cell Culture, SILAC, as a Simple and Accurate Approach to Expression Proteomics," Molecular & Cellular Proteomics 1.5, 376-386.

Ow et al. (2009), "iTRAQ Underestimation in Simple and Complex Mixtures: 'The Good, the Bad and the Ugly'", Journal of Proteome Research 2009, 8, 5347-5355, web publication Sep. 16, 2009.

Perkel (2009), "iTRAQ gets put to the test," Journal of Proteome Research (ACS Publications), 2009, 8(11), p. 4885.

ProteinPilot™ 3.0 Software product information, Applied Biosciences website, accessed Jan. 28, 2010 from https://products.appliedbiosystems.com/ab/en/US/adirect/ab?cmd=catNavigate2&catID=6 . . .

Ross, P.L. et al. (2004), "Multiplexed Protein Quantitation in *Saccharomyces cerevisiae* Using Amine-reactive Isobaric Tagging Reagents," Mol. Cell. Proteomics 3.12, 1154-1169.

Shadforth, I. P.; Dunkley, T. P. J.; Lilley, K. S.; Bessant, C. (2005), "i-Tracker: For quantitative proteomics using iTRAQ™," Bmc Genomics 2005, 6:145.

Shilov et al. (2007),"The Paragon Algorithm, a Next Generation Search Engine That Uses Sequence Temperature Values and Feature Probabilities to Identify Peptides from Tandem Mass Spectra," Molecular & Cellular Proteomic 6.9, pp. 1638-1655.

Swaney, D.L., Wenger, C.D. & Coon, J.J. (2010), "Value of using multiple proteases for large-scale mass spectrometry-based proteomics," J. Proteome Res. 2010, 9, 1323-1329. (Publication Date (Web): Jan. 29, 2010).

Thompson et al. (2003), "Tandem Mass Tags: A Novel Quantification Strategy for Comparative Analysis of Complex Protein Mixtures by MS/MS," Anal. Chem. 2003, 75, 1895-1904.

Wenger, C.D., Boyne, M.T., Ferguson, J.T., Robinson, D.E. & Kelleher, N.L. (2008), "Versatile Online—Offline Engine for Automated Acquisition of High-Resolution Tandem Mass Spectra," Anal. Chem. 80, 8055-8063.

Wenger C.D., Phanstiel DH, Lee MV, Bailey DJ, Coon JJ. (2011), "Compass: A suite of pre- and post-search proteomics software tools for OMSSA," Proteomics. Mar. 2011; 11(6):1064-74.

Yu, J. Y.; Hu, K. J.; Smuga-Otto, K.; Tian, S. L.; Stewart, R.; Slukvin, II; Thomson, J. A. (2009), "Human Induced Pluripotent Stem Cells Free of Vector and Transgene Sequences," Science 2009, 324, (5928), 797-801.

Zhang, Y. et al. (2009), "A Robust Error Model for iTRAQ Quantification Reveals Divergent Signaling between Oncogenic FLT3 Mutants in Acute Myeloid Leukemia," Mol. Cell. Proteomics 9, 780-790.

Zhu, H.N., Pan, S.Q., Gu, S., Bradbury, E.M. & Chen, X. (2002), "Amino acid residue specific stable isoptope labeling for quatitative proteomics," Rapid Commun. Mass Spectrom. 2002, 16, 2115-2123.

* cited by examiner (A)

(B)

MASS SPECTROMETRY DATA ACQUISITION MODE FOR OBTAINING MORE RELIABLE PROTEIN QUANTITATION

CROSS REFERENCE TO RELATED APPLICATIONS

This application claims the benefit of and priority under 35 U.S.C. 119(e) to U.S. Provisional Application 61/324,065 filed on Apr. 14, 2010 entitled "MASS SPECTROMETRY DATA ACQUISITION MODE FOR OBTAINING MORE RELIABLE PROTEIN QUANTITATION", which is hereby incorporated by reference in its entirety.

STATEMENT REGARDING FEDERALLY SPONSORED RESEARCH OR DEVELOPMENT

This invention was made with government support under GM080148 awarded by the National Institutes of Health. The government has certain rights in the invention.

BACKGROUND

The ability to identify proteins and determine their chemical structures has become central to the life sciences. The amino acid sequence of proteins provides a link between proteins and their coding genes via the genetic code, and, in principle, a link between cell physiology and genetics. The identification of proteins provides a window into complex cellular regulatory networks.

Ion trap mass spectrometers are among the most widely used platforms for molecular analysis—spanning natural products, to pharmaceuticals, to biologics such as proteins. Most mass spectrometer-based experiments begin with the isolation of a group of compounds from a set of samples through some sort of extraction technique, e.g., proteins from tissues, cell lysates, or fluids followed by proteolytic digestion of those proteins into peptides (i.e., bottom-up proteomics). Frequently, but not necessarily, the mass spectrometers are then coupled with some form of separations, e.g., electrophoretic or chromatographic. Over the course of just a few hours, mass spectral instruments can autonomously interrogate tens of thousands of molecular species via tandem mass spectrometry.

Quantitative analysis in chemistry is the determination of the absolute or relative abundance of one, several, or all particular substance(s) present in a sample. For biological samples, quantitative analysis performed via mass spectrometry can determine the relative abundance of peptides and proteins. The accepted methodology for performing mass spectrometric quantitation is accomplished using a mass spectrometer capable of MS/MS fragmentation (i.e., triple quadropole or ion trap). The quantitation process can involve isobaric tagging of peptide precursors, which when combined with post-acquisition software, provides the relative abundance of peptides. However, when a peptide precursor is selected for tandem mass spectrometry, there are often interfering species with similar mass-to-charge ratios that are co-isolated and subjected to activation. These species are often other isobarically tagged peptides with different relative quantitation, which therefore disturb the quantitative measurement of the peptide of interest.

Isobaric labeling is an important quantitative method as it allows for multiplexing and is directly applicable to clinical samples. A significant source of error, however, occurs when another eluting peptide ion has a m/z value that is very near that of the selected precursor (~50%, in our hands). The result is the isolation of both species, which are consequently co-dissociated, to produce a composite MS/MS spectrum. The resulting reporter ion ratios do not accurately reflect the relative abundances of either peptide; limiting both the precision and dynamic range of quantitation, as the median peptide ratio is close to 1:1.

The increasing popularity of iTRAQ for quantitative proteomics applications has spurred increased efforts to evaluate its relevance, accuracy, and precision for biological interpretation. Recently, some researchers have begun to assess the accuracy and precision of iTRAQ quantification as well as drawbacks which hinder the applicability and attainable dynamic range of iTRAQ. Some results suggest that crosstalk between interfering factors can result in underestimations. [Ow et al., "iTRAQ Underestimation in Simple and Complex Mixtures: 'The Good, the Bad and the Ugly'", Journal of Proteome Research, web publication Sep. 16, 2009]. It is clear that there is tantalizing potential for iTRAQ and other protein labeling methods to provide accurate quantification spanning several orders of magnitude. This potential can be limited, however, by several factors. First, for example, the existence of isotopic impurities often requires correction of mass spectral data to provide accurate quantitation which currently requires the availability of accurate isotopic factors. Second, the interference of mixed MS/MS contribution occurring during precursor selection is a problem that is currently very difficult to minimize.

SUMMARY

Described herein are methods and systems which enable a unique platform for analyte quantitation. The methods and systems relate to determining the amount of interference in a precursor ion isolation window resulting from an impurity. Once the level of impurity is determined, several methods can be employed to reduce the amount of interference in a subsequent MS/MS spectrum. The methods and systems described herein enable increased quantitation accuracy while maintaining high levels of throughput.

In an embodiment, a method of analyzing an analyte using mass spectrometry is provided, the method comprising: (a) providing an analyte; (b) generating a distribution of precursor ions from the analyte; (c) analyzing the mass-to-charge ratios of at least a portion of the distribution of precursor ions, thereby generating precursor ion mass spectrometry data corresponding to the distribution of precursor ions; (d) identifying a precursor peak in the precursor ion mass spectrometry data corresponding to a precursor ion; (e) fragmenting ions corresponding to a preselected range of m/z units about the precursor peak, wherein the preselected range is within 0.01 to 10 m/z units of the precursor peak, thereby generating fragment ions; (f) measuring the mass-to-charge ratios of the fragment ions, thereby generating product ion mass spectrometry data; (g) determining the amount of interference within the preselected range of m/z units about the precursor peak; and (h) analyzing the precursor ion mass spectrometry data and the product ion mass spectrometry data for which the amount of interference is less than a selected value, and not analyzing the precursor ion mass spectrometry data and the product ion mass spectrometry data for which the amount of interference is greater than or equal to the selected value; thereby analyzing the analyte using mass spectrometry.

In an alternate embodiment, a method of analyzing an analyte using mass spectrometry is provided, the method comprising: (a) providing an analyte; (b) generating a distribution of precursor ions from the analyte; (c) analyzing the mass-to-charge ratios of at least a portion of the distribution of precursor ions, thereby generating precursor ion mass spectrometry data corresponding to the distribution of precursor ions; (d) identifying a precursor peak in the precursor ion mass spectrometry data corresponding to a precursor ion; (e) determining the amount of interference within a range of 0.01 to 10 m/z units of the precursor peak; (f) fragmenting ions corresponding to the preselected range of m/z units about the precursor peak when the amount of interference is less than a selected value, thereby generating fragment ions; and not fragmenting ions corresponding to the preselected range of m/z units about the precursor peak when the amount of interference is greater than or equal to the selected value; (g) measuring the mass-to-charge ratios of the fragment ions, thereby generating product ion mass spectrometry data; and (h) analyzing the precursor ion mass spectrometry data and the product ion mass spectrometry data; thereby analyzing the analyte using mass spectrometry.

In an alternate embodiment, a method of analyzing an analyte using mass spectrometry is provided, the method comprising: (a) providing an analyte; (b) generating a distribution of precursor ions from the analyte; (c) analyzing the mass-to-charge ratios of at least a portion of the distribution of precursor ions, thereby generating precursor ion mass spectrometry data corresponding to the distribution of precursor ions; (d) identifying a precursor peak in the precursor ion mass spectrometry data corresponding to a precursor ion; (e) determining the amount of interference within a preselected range of m/z units about the precursor peak, wherein the preselected range is within 0.01 to 10 m/z units of the precursor peak; (f) fragmenting ions corresponding to the preselected range, thereby generating fragment ions; (g) measuring mass-to-charge ratios of fragment ions corresponding to a preselected range when the amount of interference is less than a selected value, and not measuring mass-to-charge ratios of fragment ions corresponding to a preselected range when the amount of interference is greater than or equal to the selected value, thereby generating product ion mass spectrometry data; and (h) analyzing the precursor ion mass spectrometry data and the product ion mass spectrometry data; thereby analyzing the analyte using mass spectrometry.

The methods and systems described herein can include adjustment of the range of m/z units such that the interference in the range is less than a selected value. In an embodiment, a method of analyzing an analyte using mass spectrometry is provided, the method comprising: (a) providing an analyte; (b) generating a distribution of precursor ions from the analyte; (c) analyzing the mass-to-charge ratios of at least a portion of the distribution of precursor ions, thereby generating precursor ion mass spectrometry data corresponding to the distribution of precursor ions; (d) identifying a precursor peak in the precursor ion mass spectrometry data corresponding to a precursor ion; (e) determining an amount of interference within a range of 0.01 to 10 m/z units of the precursor peak; (f) adjusting the isolation range of m/z units such that the amount of interference is less than a selected value; and (g) analyzing the ions within the adjusted range of m/z units; thereby analyzing the analyte using mass spectrometry.

The method can comprise, for example, wherein adjusting the range of m/z units such that the amount of interference is less than a selected value comprises: (i) identifying a largest intensity precursor peak within the range of m/z units; (ii) identifying an interference peak at lowest m/z within the range of m/z units of intensity greater than or equal to 25% of the intensity of the of the largest intensity precursor peak; (iii) identifying an interference peak at highest m/z within the range of m/z units of intensity greater than or equal to 25% of the intensity of the of the largest intensity precursor peak; (iv) identifying an m/z unit midpoint between the interference peak at lowest m/z and the interference peak at highest m/z; and (v) selecting the range of m/z units to be 75% of an m/z difference between the interference peak at lowest m/z and the interference peak at highest m/z centered on the m/z unit midpoint.

The method can also comprise, for example, wherein adjusting the range of m/z units such that the amount of interference is less than a selected value comprises: (i) setting the range of m/z units to be within 10 m/z of the precursor peak; (ii) determining the amount of interference within the range of m/z units of the precursor peak; and (iii) reducing the range of m/z units by 0.1 m/z if the amount of interference within the range of m/z units is greater than or equal to the selected value.

The method can further comprise, for example, wherein adjusting the range of m/z units such that the amount of interference is less than a selected value comprises: (i) setting the range of m/z units to be within 10 m/z of the precursor peak; (ii) determining the amount of interference within the range of m/z units of the precursor peak; and (iii) reducing the range of m/z units by 0.1 m/z if the amount of interference within the range of m/z units is greater than or equal to the selected value.

The method can further comprise, for example, wherein adjusting the range of m/z units such that the amount of interference is less than a selected value comprises: (i) setting the range of m/z units to be within 10 m/z of the precursor peak; (ii) determining the amount of interference within the isolation range of m/z units of the precursor peak; and (iii) reducing the range of m/z units by 0.01 m/z if the amount of interference within the range of m/z units is greater than or equal to the selected value.

The method can further comprise, for example, wherein adjusting the range of m/z units such that the amount of interference is less than a selected value comprises: (i) measuring a signal-to-noise ratio of the precursor peak; (ii) adjusting the range of m/z units if the signal-to-noise ratio is less than 3-to-1; and not adjusting the range of m/z units if the signal-to-noise ratio is greater than or equal to 3-to-1. In an embodiment, for example, step (ii) is provided wherein adjusting the range of m/z units if the signal-to-noise ratio is less than 4-to-1, optionally 5-to-1, optionally 10-to-1; and not adjusting the range of m/z units if the signal-to-noise ratio is greater than or equal to 3-to-1, optionally 5-to-1, optionally 10-to-1.

The method can be extended, for example, to include additional steps comprising: (h) fragmenting the ions corresponding to the precursor peak, thereby generating fragment ions; (i) measuring the mass-to-charge ratios of the fragment ions, thereby generating product ion mass spectrometry data; and (j) analyzing the precursor ion mass spectrometry data and the product ion mass spectrometry data for which the amount of interference is less than the selected value, and not analyzing the precursor ion mass spectrometry data and the product ion mass spectrometry data for which the amount of interference is greater than or equal to the selected value.

The method can be extended, for example, to include additional steps comprising: (h) fragmenting the ions corresponding to the precursor peak, provided the amount of interference is less than the selected value, thereby generating fragment ions; and not fragmenting the ions corresponding to the precursor peak, provided the amount of interference is greater than or equal to the selected value; (i) measuring the mass-to-charge ratios of the fragment ions, thereby generating product ion mass spectrometry data; and (j) analyzing the precursor ion mass spectrometry data and the product ion mass spectrometry data.

The amount of interference can be determined using many different methods. In an embodiment, for example, the amount of interference is determined by calculation of an interference ratio and the selected value is an interference ratio less than or equal to 0.5. In an embodiment, the amount of interference is determined by calculation of an interference ratio and the selected value is an interference ratio less than or equal to 0.25. In an embodiment, the amount of interference is determined by calculation of an interference ratio and the selected value is an interference ratio less than or equal to 0.1. In an embodiment, the amount of interference is determined by calculation of an interference ratio of a largest interference peak intensity within the range of m/z units to a largest precursor peak intensity within the range of m/z units. In an embodiment, the amount of interference is determined by calculation of an interference ratio of the sum of all interference peak intensities within the range of m/z units to the sum of all precursor peak intensities within the range of m/z units.

The methods herein can be practiced wherein only certain peaks are selected for consideration. Selection of certain peaks for consideration can increase, for example, the accuracy, sensitivity or throughput of the methods. In an embodiment, only peaks having intensity greater than or equal to 50% of the most intense precursor ion peak in the precursor ion mass spectrometry data are considered. In an embodiment, only peaks having intensity greater than or equal to 25% of the most intense precursor ion peak in the precursor ion mass spectrometry data are considered. In an embodiment, only peaks having intensity greater than or equal to 10% of the most intense precursor ion peak in the precursor ion mass spectrometry data are considered. In an embodiment, only peaks having a signal-to-noise ratio greater than 10-to-1 are considered. In an embodiment, only peaks having a signal-to-noise ratio greater than 4-to-1 are considered. In an embodiment, only peaks having a signal-to-noise ratio greater than 2-to-1 are considered. In an embodiment, only peaks having an isotopic abundance pattern indicative of an ionic species are considered.

Other techniques can increase the accuracy, sensitivity and/or throughput of the methods described herein. In an aspect of this embodiment, the precursor ion mass spectrometry data and product ion mass spectrometry data are only analyzed for precursor ion mass spectrometry data and product ion mass spectrometry data indicative of a single species of precursor. In an aspect, the methods further comprise discarding product ion mass spectrometry data for which the amount of interference is greater than the selected value and/or discarding product ions for which the interference is greater than the selected value.

The methods described herein can be extended to cover a wide range of precursor ion masses. In an aspect of this embodiment, the methods further comprise repeating steps (d)-(g) for at least a portion of precursor ion peaks in the precursor ion mass spectrometry data. In another aspect of this embodiment, the methods further comprise repeating steps (d)-(g) for substantially all precursor ion peaks in the precursor ion mass spectrometry data.

Selection of the range of m/z units is important to both increase sensitivity and to reduce interference from non-precursor ions. Reference to a range of m/z units about a precursor peak refers to the range extending to both the high m/z side of a precursor peak and the low m/z side of a precursor peak. Reference to a range of 0.1 to 10 m/z units about a precursor peak, for example, refers to a range of 0.1 to 10 m/z units less than the m/z unit position of the precursor peak and a range of 0.1 to 10 m/z units greater than the m/z unit position of the precursor peak. If the range of m/z units is too narrow, the sensitivity of the method will be decreased; if the range is too broad the interference will be increased. In an aspect of this embodiment, the methods further comprise adjusting the m/z isolation range such that the amount of interference in the m/z range is less than the selected value. In a further aspect, the range of m/z units is 0.01 to 5 m/z units, for some applications the range of m/z units is 0.01 to 2 m/z units.

Precursor ions can be generated using a broad range of ionization techniques and ion sources. In an embodiment, for example, the distribution of precursor ions is generated by an electrospray ionization source or a MALDI source.

In an embodiment, a mass spectrometer system for analyzing an analyte is provided, the system comprising: an ion source for generating ions from the analyte; first ion separation optics in communication with the ion source for separating ions according to their mass-to-charge ratios; a first ion detector in communication with the first ion separation optics for detecting ions separated according to their mass-to-charge ratios; ion fragmentation optics in communication with the first ion separation optics for generating ion fragments; second ion separation optics in communication with the ion fragmentation optics for separating ions according to their mass-to-charge ratios; a second ion detector in communication with the second ion separation optics for detecting ions separated according to their mass-to-charge ratios; a controller operably connected to the first and second ion separation optics, the first and second ion detectors, and the ion fragmentation optics; wherein the controller controls the ion optics and detectors so as to: (a) generate a distribution of precursor ions from the analyte; (b) analyze the mass-to-charge ratios of at least a portion of the distribution of precursor ions, thereby generating precursor ion mass spectrometry data corresponding to the distribution of precursor ions; (c) identify a precursor peak in the precursor ion mass spectrometry data corresponding to a precursor ion; (d) determine the amount of interference within a range of 0.01 to 10 m/z units of the precursor peak; (e) fragment the ions corresponding to the precursor peak, thereby generating fragment ions; (f) measure the mass-to-charge ratios of the fragment ions, provided the amount of interference is less than a selected value, thereby generating product ion mass spectrometry data; and not measure the mass-to-charge ratios of the fragment ions, provided the amount of interference is greater than or equal to the selected value; and (g) analyze the precursor ion mass spectrometry data and the product ion mass spectrometry data.

In an alternative embodiment, a mass spectrometer system for analyzing an analyte is provided, the system comprising: an ion source for generating ions from the analyte; first ion separation optics in communication with the ion source for separating ions according to their mass-to-charge ratios; a first ion detector in communication with the first ion separation optics for detecting ions separated according to their mass-to-charge ratios; ion fragmentation optics in communication with the first ion separation optics for generating fragment ions; second ion separation optics in communication with the ion fragmentation optics for separating ions according to their mass-to-charge ratios; a second ion detector in communication with the second ion separation optics for detecting ions separated according to their mass-to-charge ratios; a controller operably connected to the first and second ion separation optics, the first and second ion detectors, and the ion fragmentation optics; wherein the controller controls the ion optics and detectors so as to: (a) generate a distribution of precursor ions from the analyte; (b) analyze the mass-to-charge ratios of at least a portion of the distribution of precursor ions, thereby generating precursor ion mass spectrometry data corresponding to the distribution of precursor ions; (c) identify a precursor peak in the precursor ion mass spectrometry data corresponding to a precursor ion; (d) fragment ions corresponding to a preselected range of m/z units about the precursor peak, wherein the preselected range is within 0.01 to 10 m/z units of the precursor peak, thereby generating fragment ions; (e) measure the mass-to-charge ratios of the fragment ions, thereby generating product ion mass spectrometry data; (f) determine the amount of interference within the preselected range of m/z units about the precursor peak; and (g) analyze the precursor ion mass spectrometry data and the product ion mass spectrometry data for which the amount of interference is less than a selected value, and not analyze the precursor ion mass spectrometry data and the product ion mass spectrometry data for which the amount of interference is greater than or equal to the selected value.

In an alternative embodiment, a mass spectrometer system for analyzing an analyte is provided, the system comprising: the system comprising: an ion source for generating ions from the analyte; first ion separation optics in communication with the ion source for separating ions according to their mass-to-charge ratios; a first ion detector in communication with the first ion separation optics for detecting ions separated according to their mass-to-charge ratios; ion fragmentation optics in communication with the first ion separation optics for generating fragment ions; second ion separation optics in communication with the ion fragmentation optics for separating ions according to their mass-to-charge ratios; a second ion detector in communication with the second ion separation optics for detecting ions separated according to their mass-to-charge ratios; a controller operably connected to the first and second ion separation optics, the first and second ion detectors, and the ion fragmentation optics; wherein the controller controls the ion optics and detectors so as to: (a) generate a distribution of precursor ions from the analyte; (b) analyze the mass-to-charge ratios of at least a portion of the distribution of precursor ions, thereby generating precursor ion mass spectrometry data corresponding to the distribution of precursor ions; (c) identify a precursor peak in the precursor ion mass spectrometry data corresponding to a precursor ion; (d) determine the amount of interference within a preselected range of m/z units about the precursor peak, wherein the preselected range is within 0.01 to 10 m/z units of the precursor peak; (e) fragment ions corresponding to the preselected range when the amount of interference is less than a selected value, thereby generating fragment ions; and not fragment ions corresponding to the preselected range when the amount of interference is greater than or equal to the selected value; (f) measure mass-to-charge ratios of the fragment ions, thereby generating product ion mass spectrometry data; and (g) analyze the precursor ion mass spectrometry data and the product ion mass spectrometry data.

The controller can determine the amount of interference using many different methods. In an embodiment, for example, the controller determines the amount of interference within the range of m/z units by calculation of an interference ratio and the selected value is an interference ratio less than or equal to 0.5. In an aspect, the controller determines the amount of interference within the range of m/z units by calculation of an interference ratio and the selected value is an interference ratio less than or equal to 0.25. In another aspect, the controller determines the amount of interference within the range of m/z units by calculation of an interference ratio and the selected value is an interference ratio less than or equal to 0.1. In an aspect, the controller determines the amount of interference by calculation of an interference ratio of the largest interference peak intensity within the range of m/z units to the largest precursor peak intensity within the range of m/z units. In another aspect, the controller determines the amount of interference by calculation of an interference ratio of the sum of all interference peak intensities within the range of m/z units to the sum of all precursor peak intensities within the range of m/z units.

Selection of certain peaks for consideration by the controller can increase, for example, the accuracy, sensitivity or throughput of the systems. In an embodiment, for example, the controller only considers peaks having intensity greater than or equal to 50% of the most intense precursor ion peak in the precursor ion mass spectrometry data. In an aspect, the controller only considers only peaks having intensity greater than or equal to 25% of the most intense precursor ion peak in the precursor ion mass spectrometry data. In another aspect, the controller only considers peaks having intensity greater than or equal to 10% of the most intense precursor ion peak in the precursor ion mass spectrometry data. In an aspect, the controller only considers peaks having a signal-to-noise ratio greater than 10-to-1. In another aspect, the controller only considers peaks having a signal-to-noise ratio greater than 4-to-1. In a further aspect, the controller only considers peaks having a signal-to-noise ratio greater than 2-to-1. In an aspect, the controller only considers peaks having an isotopic abundance pattern indicative of an ionic species.

The controller can control the ion optics and detectors to increase the accuracy, sensitivity and/or throughput of the systems described herein. In an aspect of this embodiment, the controller only analyzes precursor ion mass spectrometry data and product ion mass spectrometry data for precursor ion mass spectrometry data and product ion mass spectrometry data indicative of a single species of precursor. In a related embodiment, the controller further discards product ion mass spectrometry data for which the interference ratio is greater than the selected value. In an aspect, the controller controls the ion optics and detectors so as to discard product ions for which the amount of interference is greater than the selected value.

The systems described herein can be configured to cover a wide range of precursor ion masses. In an aspect of this embodiment, for example, the controller controls the ion optics and detectors so as to repeat steps (c)-(f) for at least a portion of precursor ion peaks in the precursor ion mass spectrometry data. In an aspect, the controller controls the ion optics and detectors so as to repeat steps (c)-(f) for substantially all precursor ion peaks in the precursor ion mass spectrometry data.

Selection of the range of m/z units is important to both increase sensitivity and to reduce interference from non-precursor ions. If the range of m/z units is too narrow, the sensitivity of the method will be decreased; if the range is too broad the interference will be increased. In an aspect of this embodiment, the controller controls the ion optics and detectors to adjust the m/z range such that the amount of interference in the m/z range is less than the selected value. In an aspect, the range of m/z units is 0.01 to 5 m/z units. In a further aspect, the range of m/z units is 0.01 to 2 m/z units.

Precursor ions can be generated using a broad range of ionization techniques and ion sources. In an embodiment, for example, the ion source is an electrospray ionization source or a MALDI source.

The systems and methods described herein are useful for analysis of a wide array of analytes. In an embodiment, for example, the analyte comprises proteins or peptides. In an aspect, the analyte comprises phosphorylated proteins or peptides. In another aspect, the analyte comprises co-translationally modified proteins or peptides. In an aspect, the analyte comprises post-translationally modified proteins or peptides. In a further aspect, the analyte comprises small molecules, pharmaceutical compounds, oligonucleotides, or sugars. In another aspect, the analyte comprises isobarically labeled proteins or peptides.

In an embodiment, for example, the analyte comprises proteins or peptides and the analyte is analyzed to quantify the amount of proteins or peptides in the analyte. In another aspect, the analyte comprises one or more proteins. In an aspect, the one or more proteins are digested. In a further aspect, the methods and systems described herein are useful for identifying peptides corresponding to the one or more proteins. In an aspect, the methods and systems described herein are useful for determining amounts of the one or more proteins. In an aspect, the methods and systems described herein are useful for determining a composition of the one or more proteins. In an aspect, the methods and systems described herein are useful for determining a post translational modification of the one or more proteins. In a related embodiment, the one or more proteins are indicative of a disease state.

Analytes compatible with the systems and methods described herein can be processed. In an embodiment, for example, the analyte is fractionated prior to generating the distribution of precursor ions from the analyte.

The methods described herein can be carried out on a wide range of instruments. In an embodiment, for example, the methods can be implemented in a tandem mass spectrometer instrument or a multistage mass spectrometer instrument.

BRIEF DESCRIPTION OF THE FIGURES

FIG. 10 provides a plot showing signal-to-noise ratios (S/N) of precursors selected for MS/MS with ("ON" trace) and without ("OFF" trace) QuantMode. When QuantMode is enabled, precursors of significantly lower S/N are sampled, with a mode of ~1.5 compared to ~4 when QuantMode is disabled. The distribution also skews more into the low S/N region when QuantMode is on.

DETAILED DESCRIPTION

Figure 1:
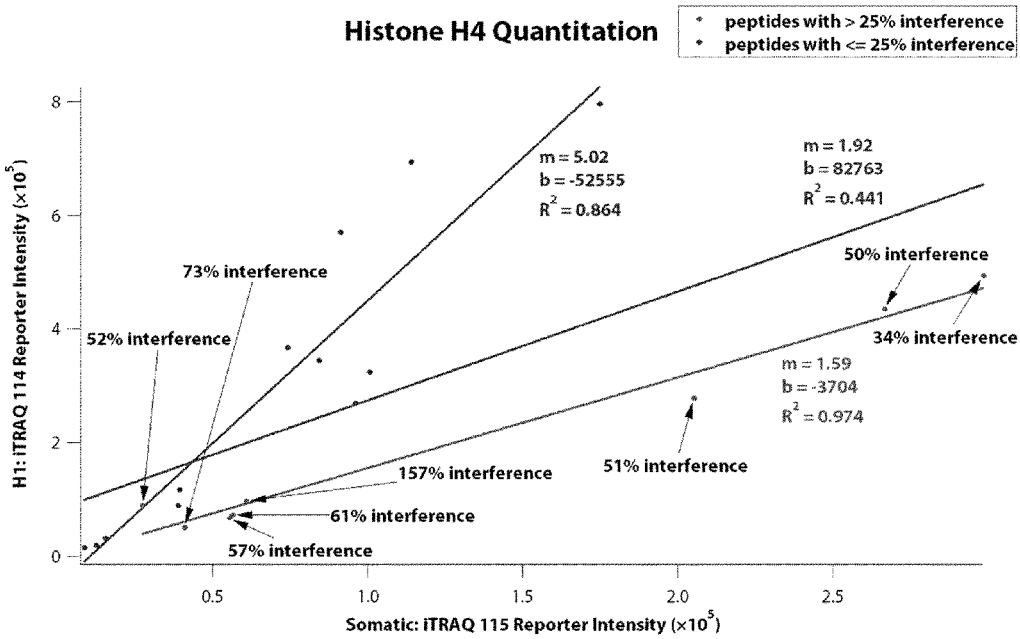
FIG. 1 provides quantitation results for a protein that is known to be up-regulated in the y-axis cell line versus the x-axis cell line: human histone H4. The blue data points are those which have less than 25% interference—when analyzed alone (blue fit line) they show a ~5-fold up-regulation with good correlation ($R^2$=0.86). When all data points are analyzed without regard to interference (purple fit line), only a ~2-fold up-regulation is observed, and with relatively poor correlation ($R^2$=0.44). When only the high-interference red data points are analyzed alone (red fit line), they show a ~1.5-fold up-regulation due to the fact that the median protein ratio is 1:1.

Referring to the drawings, like numerals indicate like elements and the same number appearing in more than one drawing refers to the same element. In general the terms and phrases used herein have their art-recognized meaning, which can be found by reference to standard texts, journal references and contexts known to those skilled in the art. The following definitions are provided to clarify their specific use in the context of the invention.

As used herein, the terms "product ion" and "secondary ion" are used interchangeably in the present description and refer to an ion which is produced during a fragmentation process of a precursor ion. The term "secondary product ion" as used herein refers to an ion which is the product of successive fragmentations.

As used herein, the term "analyzing" refers to a process for determining a property of an analyte. Analyzing can determine, for example, physical properties of analytes, such as mass or atomic or substituent composition.

As used herein, the term "analyte" refers to a compound or composition which is the subject of an analysis. Analytes include, but are not limited to, proteins, peptides, small molecules, pharmaceutical compounds, oligonucleotides, and sugars.

As used herein, the term "ion source" refers to a device component which produces ions from a sample. Examples of ion sources include, but are not limited to, electrospray ionization sources and matrix assisted laser desorption/ionization (MALDI) sources.

As used herein, the term "mass spectrometry" refers to an analytical technique for the determination of the elemental composition of an analyte. Mass spectrometric techniques are useful for elucidating the chemical structures of analytes, such as peptides and other chemical compounds. The mass spectrometry principle consists of ionizing analytes to generate charged species or species fragments and measurement of their mass-to-charge ratios. Conducting a mass spectrometric analysis of an analyte results in the generation of mass spectrometry data relating to the mass-to-charge ratios of the analyte and analyte fragments. Mass spectrometry data corresponding to analyte ion and analyte ion fragments is presented in mass-to-charge (m/z) units representing the mass-to-charge ratios of the analyte ions and/or analyte ion fragments.

As used herein, the term "interference" refers to a species detected in an analysis which interferes with the detection of a species or analyte of interest. Interference can refer to detection of a protein, or protein fragment, which is not a protein or protein fragment of interest and which interferes with the accurate detection or quantitation of the protein or peptide fragment of interest. Interference can be quantified as an interference ratio, such as a ratio of an amount of interference signal to an amount of analyte signal. In a mass spectral analysis, interference can be manifested as an interference peak which corresponds to detection of a species which is not an analyte of interest.

As used herein, the term "signal-to-noise ratio" refers to a measure which quantifies how much a signal has been corrupted by noise, or unwanted signal. It can also refer to the ratio of signal power to the noise power corrupting the signal. A ratio higher than 1:1 indicates more signal than noise and is desirable for some applications.

As used herein, the term "mass-to-charge ratio" refers to the ratio of the mass of a species to the charge state of a species. The term "m/z unit" refers to a measure of the mass to charge ratio. The Thomson unit (abbreviated as Th) is an example of an m/z unit and is defined as the absolute value of the ratio of the mass of an ion (in Daltons) to the charge of the ion (with respect to the elemental charge).

As used herein, the term "ion optic" refers to a device component which assists in the transport and manipulation of charged particles, for example ions, by the application of electric and/or magnetic fields. The electric or magnetic field can be static, alternating, or can contain both static and alternating components. Ion optical device components include, but are not limited to, ion deflectors which deflect ions, ion lenses which focus ions, and multipoles (such as quadruples) which confine ions to a specific space or trajectory. Ion optics include multipole RF device components which comprise multiple rods having both static and alternating electric and/or magnetic fields.

As used herein, the term "mass spectrometer" refers to a device which creates ions from a sample, separates the ions according to mass, and detects the mass and abundance of the ions. Mass spectrometers include multistage mass spectrometers which fragment the mass-separated ions and separate the product ions by mass one or more times. Multistage mass spectrometers include tandem mass spectrometers which fragment the mass-separated ions and separate the product ions by mass once.

As used herein, the term "disease state" refers to condition that can cause pain, dysfunction, distress, social problems, and/or death to a patient. Methods and systems described herein can be useful for diagnosis of a disease state.

The terms "peptide" and "polypeptide" are used synonymously in the present description, and refer to a class of compounds composed of amino acid residues chemically bonded together by amide bonds (or peptide bonds). Peptides and polypeptides are polymeric compounds comprising at least two amino acid residues or modified amino acid residues. Modifications can be naturally occurring or non-naturally occurring, such as modifications generated by chemical synthesis. Modifications to amino acids in peptides include, but are not limited to, phosphorylation, glycosylation, lipidation, prenylation, sulfonation, hydroxylation, acetylation, methylation, methionine oxidation, alkylation, acylation, carbamylation, iodination and the addition of cofactors. Peptides include proteins and further include compositions generated by degradation of proteins, for example by proteolyic digestion. Peptides and polypeptides can be generated by substantially complete digestion or by partial digestion of proteins. Polypeptides include, for example, polypeptides comprising 1 to 100 amino acid units, optionally for some embodiments 1 to 50 amino acid units and, optionally for some embodiments 1 to 20 amino acid units.

"Protein" refers to a class of compounds comprising one or more polypeptide chains and/or modified polypeptide chains. Proteins can be modified by naturally occurring processes such as post-translational modifications or co-translational modifications. Exemplary post-translational modifications or co-translational modifications include, but are not limited to, phosphorylation, glycosylation, lipidation, prenylation, sulfonation, hydroxylation, acetylation, methylation, methionine oxidation, the addition of cofactors, proteolysis, and assembly of proteins into macromolecular complexes. Modification of proteins can also include non-naturally occurring derivatives, analogues and functional mimetics generated by chemical synthesis. Exemplary derivatives include chemical modifications such as alkylation, acylation, carbamylation, iodination or any modification that derivatizes the protein.

As used herein, the term "controller" refers to a device component which can be programmed to control a device or system, as is well known in the art. Controllers can, for example, be programmed to control mass spectrometer systems as described herein. Controllers can be programmed, for example, to carry out ion manipulation and sample analysis methods as described herein on systems and devices as described herein.

As used herein, the term "fractionated" or "fractionate" refers to the physical separation of a sample, as is well known in the art. A sample can be fractionated according to physical properties such as mass, length, or affinity for another compound, among others using chromatographic techniques as are well known in the art. Fractionation can occur in a separation stage which acts to fractionate a sample of interest by one or more physical properties, as are well known in the art. Separation stages can employ, among other techniques, liquid and gas chromatographic techniques. Separation stages include, but are not limited to, liquid chromatography separation systems, gas chromatography separation systems, affinity chromatography separation systems, and capillary electrophoresis separation systems.

EXAMPLE 1

Real-Time Mass Spectrometry Data Acquisition Method for Improved Protein Quantitation with Isobarically Labeled Peptides Introduction Isobaric labeling is an important quantitative method as it allows for multiplexing and is directly applicable to clinical samples. A significant source of error, however, occurs when another eluting peptide ion has a m/z value that is very near that of the selected precursor (~50%, in our hands). The result is the isolation of both species, which are consequently co-dissociated, to produce a composite MS/MS spectrum. The resulting reporter ion ratios do not accurately reflect the relative abundances of either peptide; limiting both the precision and dynamic range of quantitation, as the median peptide ratio is close to 1:1. Here we describe an acquisition strategy that prevents the collection of tandem mass spectra from co-isolated precursors.

Method

We developed a data acquisition strategy, termed "QuantMode", that performs an on-the-fly analysis of the precursor purity in the MS1 high resolution orbitrap data before proceeding with fragmentation. This additional step in the data-dependent precursor selection logic has been implemented in the instrument firmware of a Thermo Scientific LTQ Orbitrap Velos. We have tested this approach on whole-cell lysates of human H1 embryonic stem (ES) cells, H9 ES cells, induced pluripotent stem (iPS) cells, and neo-natal foreskin fibroblasts (NFF). These samples were separately digested with trypsin and labeled with four different iTRAQ 4-plex tags. The peptides were combined and analyzed via LC-MS/MS, utilizing a data-dependent top-10 HCD method.

For each candidate precursor, first we calculate our window of interest around the precursor in the MS^1 mass spectrum, by taking the mass-to-charge ratio (m/z) of the current precursor and adding and subtracting half the user-specified precursor isolation window width (typically 3.6 m/z for a 3 m/z isolation). We then call an instrument firmware function that returns the nth most intense peak within this window. While peaks are still available in the window, we get the m/z and intensity of the next most intense one. We calculate the mass difference to the precursor by taking the current m/z minus the precursor m/z, then multiply by charge. We adjust for the possibility of it being an isotopic peak of the precursor by dividing this mass difference by the expected isotopic spacing (the mass of a C-13 isotope minus a C-12 isotope, 1.00335 Da), rounding to the nearest integer, multiplying by the expected isotopic spacing, and subtracting this quantity from the mass difference. We call this value the adjusted mass error. This is then converted to units of parts per million (ppm) by dividing by the approximate precursor mass (precursor m/z times charge), and multiplying by one million.

If the absolute value of the adjusted mass error is less than or equal to the user-specified mass error tolerance (typically +/−25 ppm), we judge this peak to be a precursor peak. If its intensity is greater than the most intense precursor peak observed thus far, we set a precursor intensity variable equal to its intensity. If the absolute value of the ppm mass error is greater than the mass tolerance, we check if the intensity is greater than the most intense interference peak observed thus far. If it is, we set a interference intensity variable equal to its intensity.

This process continues for every peak inside the window of interest. After every peak is exhausted, we calculate the precursor interference as the maximum impurity intensity divided by the maximum precursor intensity. If this quantity is greater than the user-specified threshold (typically 0.25), we skip this precursor; otherwise, analysis on this precursor continues as normal.

Preliminary Data

We acquired triplicate nLC-MS/MS analyses of the H1/H9/iPS/NFF peptide mixture for each of three modes: QuantMode disabled, QuantMode enabled, and QuantMode control (where calculations were performed but no precursors were excluded). The number of PSMs identified at a 1% FDR for these three strategies was 12,582±208, 9,752±54, and 12,554±125, respectively. This translated to 7,154±185, 5,202±111, and 7,062±18 unique peptides. Comparison between the QuantMode-disabled and control runs demonstrate that the QuantMode calculations have no statistically significant effect on duty cycle. The QuantMode-enabled runs confidently identified 22% fewer PSMs and 27% fewer unique peptides than with QuantMode disabled, due to lower total number of tandem mass spectra acquired. However, for the QuantMode-disabled runs, 69% of the spectra were unusable for quantitation as they contained precursor interference greater than 25%, yielding only 3,944±46 quantifiable PSMs. In the QuantMode-enabled runs, all 9,752 PSMs were quantifiable—a 147% increase over the QuantMode-disabled runs. In terms of proteins, 1,617±16, 1,192±44, and 1,618±14 were identified at a 1% FDR for the three strategies, respectively. Again, although the number of proteins identified dropped by 26% with QuantMode enabled, the QuantMode-disabled runs incurred a significant loss of quantifiable proteins: 53% to 759±15. By contrast, with QuantMode enabled, every single protein of the 1192 detected was quantifiable—an increase of 57%. From these results we conclude that when quantitation is the priority, QuantMode affords massive increases in the number of quantifiable spectra and proteins from isobaric labeling experiments.

EXAMPLE 2

Experimental Details

Cell Growth and Lysis

Human embryonic stem cells (lines H1 and H9) and induced pluripotent cells (line DF-19-9-7T, see Yu, J. Y.; Hu, K. J.; Smuga-Otto, K.; Tian, S. L.; Stewart, R.; Slukvin, II; Thomson, J. A., Human Induced Pluripotent Stem Cells Free of Vector and Transgene Sequences. Science 2009, 324, (5928), 797-801) were maintained in a feeder independent system, as previously described [see Ludwig, T. E.; Bergendahl, V.; Levenstein, M. E.; Yu, J. Y.; Probasco, M. D.; Thomson, J. A., Feeder-independent culture of human embryonic stem cells. Nature Methods 2006, 3, (8), 637-646]. All ES and iPS cell lines were karyotyped prior to experiments using standard G-banding chromosome analysis (Cytogenetics Research Lab, WiCell Research Institute, Madison, Wis.). Upon reaching 70% confluency, cells were passaged enzymatically using dispase (Invitrogen) at a 1:4 splitting ratio. Human newborn foreskin fibroblasts (Cat# CRL-2097™, ATCC) were cultured essentially according to ATCC recommendations. Briefly, cells were maintained in 10% FBS (Hyclone Laboratories Incorporated), 1 mM L-glutamine (Invitrogen), 0.1 mM beta-mercaptoethanol (Sigma-Aldrich), and 0.1 mM non-essential amino acids in DMEM (both from Invitrogen). At roughly 70% confluency, cells were passaged at a 1:3 splitting ratio using Tryp-LE (Invitrogen).

All cells were harvested by individualizing for 10 minutes with an adequate volume of pre-warmed (37° C.), 0.05% Tryp-LE to cover the culture surface. Following cell detachment, an equivalent volume of either ice-cold growth media, in the case of fibroblast cells, or ice-cold DPBS (Invitrogen), in the case of ES cells, was added to before collecting the cells. Cell pellets were subsequently washed twice in ice-cold PBS and stored at −80° C. Approximately $10^8$ cells were collected for each analysis.

Samples were lysed via sonication in lysis buffer containing 40 mM NaCl, 50 mM tris, 2 mM mgCl2, 50 mM NaF, 50 mM b-glyceradelhyde phosphate, 1 mM sodium orthovanadate, 10 mM sodium pyrophosphate, 1 mini EDTA-free protease inhibitor (Roche Diagnostics), and 1 phosSTOP phosphatase inhibitor (Roche Diagnostics).

Digestion and iTRAQ Labeling

Cysteine residues were reduced with DTT, alkylated using iodoacetamide, and digested in a two step process. Proteinase Lys-C (Wako Chemicals) was added (enzyme:protein ratio=1:100) and incubated for approximately 2 hours at 37° C. in lysis buffer. Samples were then diluted with 50 mM tris pH until the urea concentration was 1.5 M and digested with trypsin (Promega) (enzyme:protein ratio=1:50) at 37° C. overnight. Reactions were quenched using trifluoroacetic acid (TFA). Samples were dried to completion and purified using C18 solid phase extraction (SPE) columns (SepPak, Waters). iTRAQ labeling was performed according to manufacturer supplied protocols. Briefly, dired samples were resuspended in 34 μL of dissolution buffer. Tags were diluted in 70 μL. To ensure that each of the four samples contained the same amount of protein a small 1:1:1:1 aliquot was prepared and analyzed by mass spectrometry. Summed reporter ion ratios from this experiment were used to inform mixing ratios of the remaining labeled digests. Once mixed, samples were dried to completion and purified by solid phase extraction (SPE).

Fractionation

The labeled peptides were resuspended in strong cation exchange (SCX) buffer A [5 mM $KH_2PO_4$, 30% acetonitrile (pH 2.65)] and injected in onto a polysulfoethyl aspartamide column (9.4×200 mm; PolyLC). Separations were performed using a Surveyor LC quaternary pump (Thermo Scientific) at a flow rate of 3.0 mL/min. The following gradient was used for separation: 0-2 min, 100% buffer A, 2-5 min, 0-15% buffer B, 5-35 min, 15-100% buffer B. Buffer B was held at 100% for 10 minutes. Finally, the column was washed extensively with buffer C and water prior to recalibration. The following buffers were used: buffer A [5 mM $KH_2PO_4$, 30% acetonitrile (pH 2.65)], buffer B [5 mM $KH_2PO_4$, 30% acetonitrile, 350 mM KCl (pH 2.65)], buffer C [50 mM $KH_2PO_4$, 500 mM KCl (pH 7.5)]. Samples were collected by hand and desalted by SPE.

Mass Spectrometry

Tandem mass spectrometry was performed using a NanoAcquity HPLC system (Waters) coupled to a dcQLT-orbitrap (Thermo Fisher Scientific). Samples were loaded onto a precolumn (75 μm ID, packed with 5 cm C18 particles, Alltech) for 10 min at a flow rate of 1 μm/min. Samples were then eluted over an analytical column (50 μm ID, packed with 15 cm C18 particles, Alltech) using a 120 min linear gradient from 1% to 35% acetonitrile with 0.2% formic acid and a flow rate of 300 nL/min. An additional 30 min were used for column washing and equilibration. The column making procedure was previously described [see McAlister, G. C.; Phanstiel, D.; Wenger, C. D.; Lee, M. V.; Coon, J. J., Analysis of Tandem Mass Spectra by FTMS for Improved Large-Scale Proteomics with Superior Protein Quantification. Analytical Chemistry 2010, 82, (1), 316-322].

All mass spectrometer instrument methods consisted of one $MS^1$ (resolving power=60,000) scan followed by data dependent $MS^2$ scans (resolving power=7,500) of the ten most intense precursors. Protein identification experiments used exclusively beam-type CAD (HCD) with orbitrap mass analysis. Some phosphopeptide identification experiments included alternating HCD and ETD $MS^2$ scans. Any peptides identified by ETD were quantified using the corresponding HCD scan. Once selected precursors were put on an exclusion list for 60 s using a window of −0.55 Th to 2.55 Th. Precursors with unassigned charges states or charge states of one (and two for ETD scans) were also excluded. AGC target values were 1,000,000 for $MS^1$ analysis and 50,000 for orbitrap $MS^2$ analysis.

Database Search and FDR Analysis

Peak information was extracted from .RAW files and printed into a searchable text file using DTA Generator [see Good, D. M.; Wenger, C. D.; McAlister, G. C.; Bai, D. L.; Hunt, D. F.; Coon, J. J., Post-Acquisition ETD Spectral Processing for Increased Peptide Identifications. Journal of the American Society for Mass Spectrometry 2009, 20, (8), 1435-1440]. Fragment ions related to the iTRAQ reagents and charged reduced precursors were removed. The Open Mass Spectrometry Search Algorithm (OMSSA; version 2.1.4) [see Geer, L. Y.; Markey, S. P.; Kowalak, J. A.; Wagner, L.; Xu, M.; Maynard, D. M.; Yang, X. Y.; Shi, W. Y.; Bryant, S. H., Open mass spectrometry search algorithm. Journal of Proteome Research 2004, 3, (5), 958-964] was used to search spectra against the International Protein Index (IPI; http://www.ebi.ac.uk/IPI/) human database version 3.57 [see Kersey, P. J.; Duarte, J.; Williams, A.; Karavidopoulou, Y.; Birney, E.; Apweiler, R., The International Protein Index: An integrated database for proteomics experiments. Proteomics 2004, 4, (7), 1985-1988] with full enzyme specificity. A mass tolerance of ±4.5 Da was used for the precursor, while a monoisotopic mass tolerance of ±0.01 Da was used for fragments ions. As shown recently [see Hsieh, E. J.; Hoopmann, M. R.; Maclean, B.; Maccoss, M. J., Comparison of Database Search Strategies for High Precursor Mass Accuracy MS/MS Data. J Proteome Res 2009], performing database searches with broad precursor tolerances and filtering during FDR calculations provides more sensitivity in identification than performing searches with narrow precursor tolerances. Carbamidomethylation of cysteines, iTRAQ 4-plex on the N-terminus, and iTRAQ 4-plex on lysines were set as fixed modifications, while oxidation of methionines and iTRAQ 4-plex on tyrosines were set as variable modifications. False discovery rate (FDR) analysis was performed with custom software that iteratively checks combinations of expectation value (e-value) score and precursor mass error to find thresholds that maximize unique peptide identifications while satisfying 1% FDR. Peptides were grouped into proteins following the rules previously established [see Nesvizhskii, A. I.; Aebersold, R., Interpretation of shotgun proteomic data—The protein inference problem. Molecular & Cellular Proteomics 2005, 4, (10), 1419-1440]. Peptide level P-scores for unique peptides corresponding to each protein were multiplied to obtain protein P-Scores. Proteins were filtered by this score to achieve a 1% FDR.

Peptide and Protein Quantitation iTRAQ quantification was performed by custom software, TagQuant. TagQuant is written in C# programming language. Reporter ion intensities were extracted and multiplied by injection times to determine counts. Purity correction was performed as previously described [see Shadforth, I. P.; Dunkley, T. P. J.; Lilley, K. S.; Bessant, C., i-Tracker: For quantitative proteomics using iTRAQ™. Bmc Genomics 2005, 6]. The intensities were normalized such that the total signal from each channel (114, 115, 116, and 117) was equal. Reporter ion intensities for each channel were summed for all peptides in a given protein with three exceptions; (1) scans corresponding to peptides found in multiple protein groups were not used for quantification (2) Peptides found to be phosphorylated, acetylated, or methylated were not used for protein quantification and (3) if peaks not related to the precursor were present in the MS1 scan within +/−1.8 Th of the selected precursor at an intensity greater than 25% of the selected precursor the resulting $MS^2$ scan was not used for quantification.

EXAMPLE 3

Further Experimental Results

Figure 3:
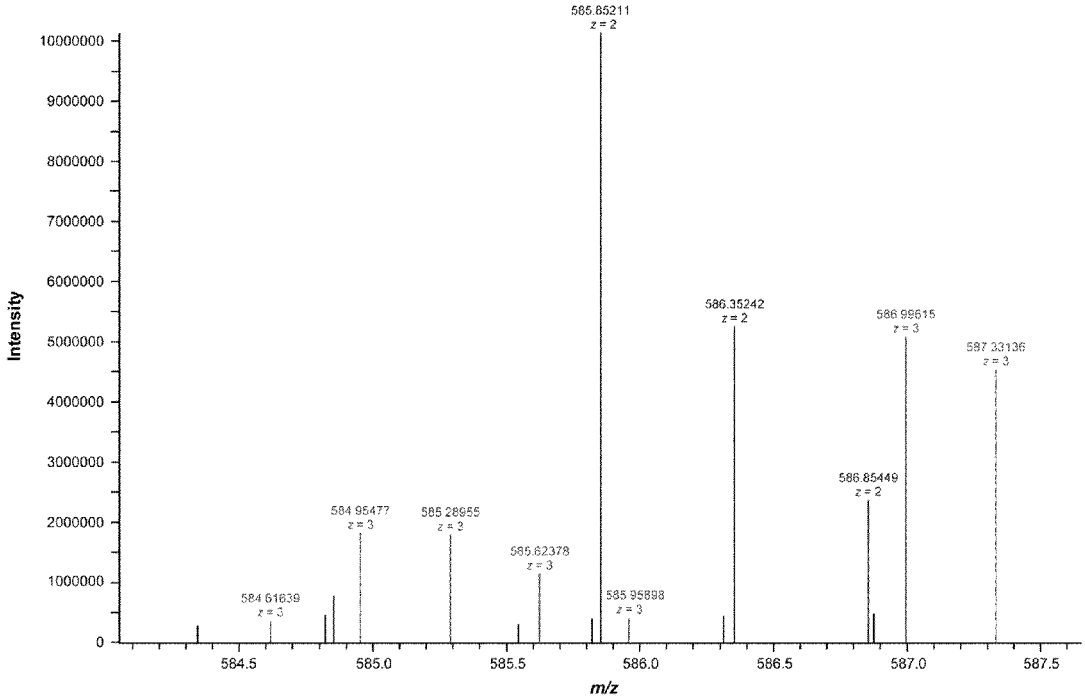
FIG. 3 provides an example of a section of an $MS^1$ spectrum with a precursor (+2 charge state) selected for fragmentation in blue and two interference species in red (both +3 charge state).

Table Ex3_1 shows each step in the calculation of every peak in the window as either precursor or interference, then calculates the overall precursor interference for the precursor region of the $MS^1$ spectrum in FIG. 3.

FIG. 1 provides quantitation results for a protein that is known to be upregulated in the y-axis cell line versus the x-axis cell line: human histone H4. The blue data points are those which have less than 25% interference—when analyzed alone (blue fit line) they show a ~5-fold upregulation with good correlation ($R^2$=0.86). When all data points are analyzed without regard to interference (purple fit line), only a ~2-fold upregulation is observed, and with relatively poor correlation ($R^2$=0.44). When only the high-interference red data points are analyzed alone (red fit line), they show a ~1.5-fold upregulation due to the fact that the median protein ratio is 1:1.

Figure 2:
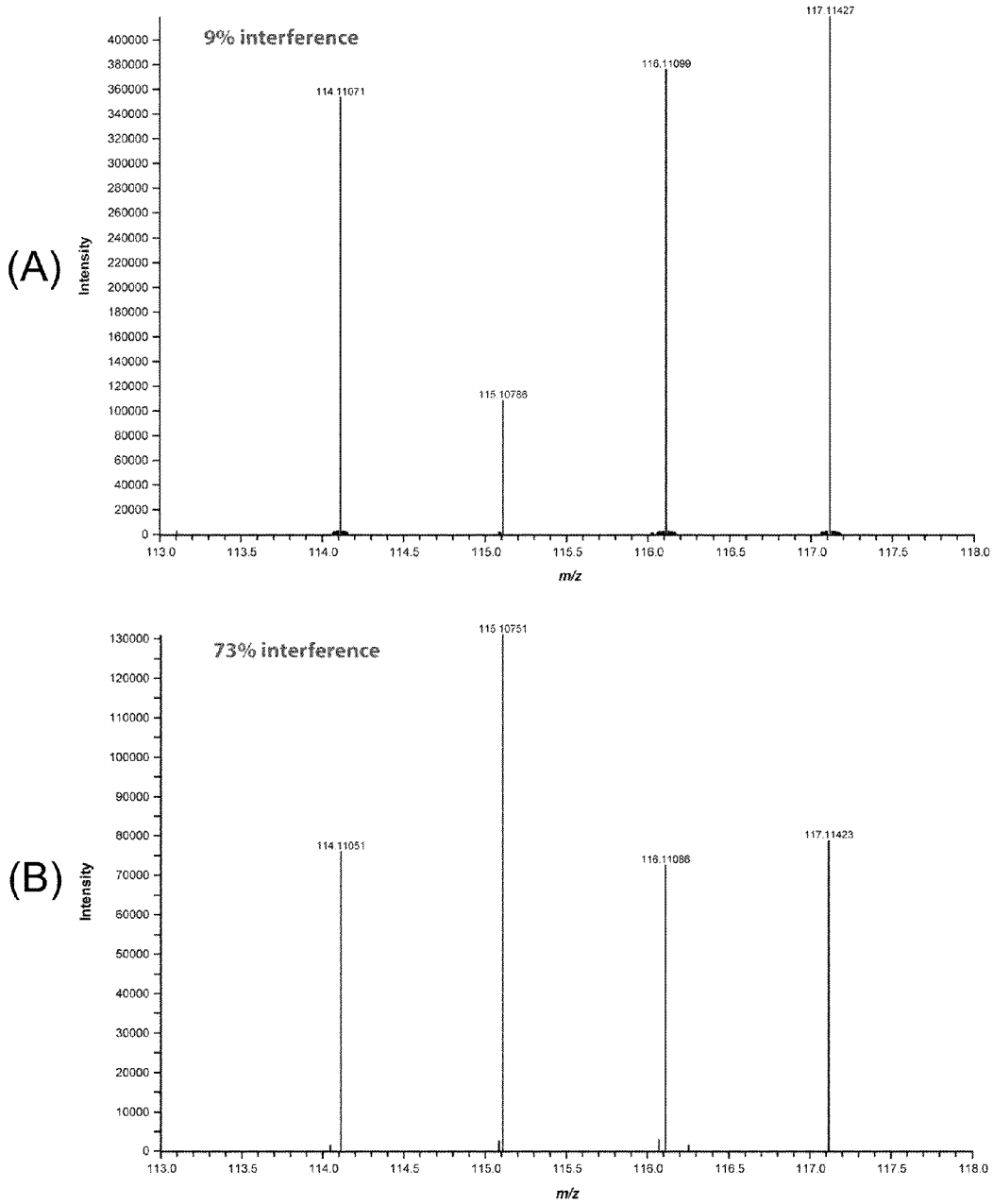
FIG. 2 provides data from the iTRAQ reporter region for two spectra plotted in FIG. 1, one with 9% interference (panel A), showing a high level of up-regulation (m/z 114 peak is much more intense than m/z 115), as expected, compared to a spectrum with 73% interference (panel B), where there is down-regulation.

FIG. 2 provides data from the iTRAQ reporter region for two spectra plotted in FIG. 1, one with 9% interference (panel A), showing a high level of up-regulation (m/z 114 peak is much more intense than m/z 115), as expected, compared to a spectrum with 73% interference (panel B), where there is down-regulation.

FIG. 3 provides an example of a section of an $MS^1$ spectrum with a precursor (+2 charge state) selected for fragmentation in blue and two interference species in red (both +3 charge state).

Figure 4:
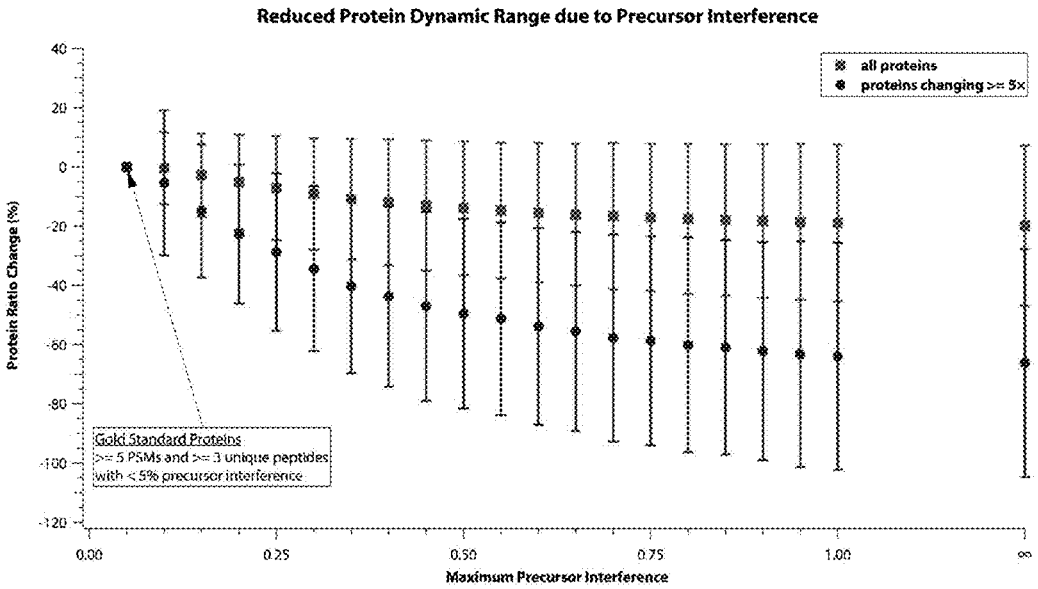
FIG. 4 provides a plot showing the effects of interference on protein dynamic range and precision. An extracted set of "gold standard" proteins with high-confidence, low-interference quantitation was used to determine the reference protein change. The change in the protein ratio as spectra with progressively higher levels of interference were added (red series) was examined. The trend is particularly evident for strongly up- or down-regulated proteins (blue series), for which ~70% of the change is lost when no interference filtering is performed. Interference also results in worse precision of quantitation, as shown by the growing error bars with increasing interference.

FIG. 4 provides a plot showing the effects of interference on protein dynamic range and precision. An extracted set of "gold standard" proteins with high-confidence, low-interference quantitation was used to determine the reference protein change. The change in the protein ratio as spectra with progressively higher levels of interference were added (red series) was examined. The trend is particularly evident for strongly up- or down-regulated proteins (blue series), for which ~70% of the change is lost when no interference filtering is performed. Interference also results in worse precision of quantitation, as shown by the growing error bars with increasing interference.

Tables Ex3_2 to Ex3_4 provide results comparing having on-the-fly filtering enabled ("QuantMode on") versus normal data acquisition ("QuantMode off") for three separate experiments. The information provided varies slightly but the basic idea is the same for all three—with on-the-fly filtering you TABLE Ex3_1

| m/z (Th) | Intensity | Mass Difference (Da) | Adjusted Mass Difference (Da) | Adjusted Mass Difference (ppm) | Classification |
|---|---|---|---|---|---|
| 584.34357 | 261074.5 | −3.01708 | −0.01708 | −14.57705768 | precursor |
| 584.61639 | 334621.8 | −2.47144 | −0.47144 | −402.3541026 | inteference |
| 584.82275 | 433377.2 | −2.05872 | −0.05872 | −50.11503671 | inteference |
| 584.85291 | 758840.9 | −1.9984 | 0.0016 | 1.365532335 | precursor |
| 584.95477 | 1799723.6 | −1.79468 | 0.20532 | 175.2319369 | inteference |
| 585.28955 | 1777294.4 | −1.12512 | −0.12512 | −106.7846286 | inteference |
| 585.54456 | 277682.5 | −0.6151 | 0.3849 | 328.4958724 | inteference |
| 585.62378 | 1120313.1 | −0.45666 | −0.45666 | −389.7399977 | inteference |
| 585.81934 | 387908.2 | −0.06554 | −0.06554 | −55.93561829 | inteference |
| 585.85211 | 10112623 | 0 | 0 | 0 | precursor |
| 585.95898 | 400330.9 | 0.21374 | 0.21374 | 182.4180509 | inteference |
| 586.31384 | 423499.9 | 0.92346 | −0.07654 | −65.3236531 | inteference |
| 586.35242 | 5230559 | 1.00062 | 0.00062 | 0.52914378 | precursor |
| 586.85449 | 2352339.8 | 2.00476 | 0.00476 | 4.062458698 | precursor |
| 586.87622 | 455403.9 | 2.04822 | 0.04822 | 41.15373076 | inteference |
| 586.99615 | 5065744.5 | 2.28808 | 0.28808 | 245.864097 | inteference |
| 587.33136 | 4521541 | 2.9585 | −0.0415 | −35.41849495 | inteference |
| | | | max interference intensity | | 5065744.5 |
| | | | max precursor intensity | | 10112623 |
| | | | | interference | 0.500932795 |

lose a small but significant percent of peptide-spectrum matches (PSMs), peptides, and proteins. However, this is more than made up for by the fact that with the real-time filtering enabled almost everything is quantifiable.

TABLE Ex3_2

| | Replicate | PSMs | Unique Peptides | Quantifiable PSMs | Proteins | Quantifiable Proteins |
|---|---|---|---|---|---|---|
| QuantMode Off | 1 | 12449 | 7076 | 3924 | 1629 | 742 |
| | 2 | 12476 | 7021 | 3911 | 1599 | 768 |
| | 3 | 12822 | 7365 | 3996 | 1622 | 767 |
| | mean | 12582 | 7154 | 3944 | 1617 | 759 |
| | st dev | 208 | 185 | 46 | 16 | 15 |
| QuantMode On | 1 | 9718 | 5281 | 9718 | 1240 | 1240 |
| | 2 | 9815 | 5249 | 9815 | 1181 | 1181 |
| | 3 | 9724 | 5075 | 9724 | 1154 | 1154 |
| | mean | 9752 | 5202 | 9752 | 1192 | 1192 |
| | st dev | 54 | 111 | 54 | 44 | 44 |
| QuantMode Control | 1 | 12446 | 7041 | 3915 | 1606 | 752 |
| | 2 | 12691 | 7073 | 3882 | 1633 | 754 |
| | 3 | 12524 | 7073 | 4071 | 1615 | 769 |
| | mean | 12554 | 7062 | 3956 | 1618 | 758 |
| | st dev | 125 | 18 | 101 | 14 | 9 |

TABLE Ex3_3

| | PSMs | quantifiable PSMs | peptides | quantifiable peptides | proteins | quantifiable proteins |
|---|---|---|---|---|---|---|
| QuantMode off | 130303 | 59954 (46.0%) | 52058 | 28281 (54.3%) | 6173 | 4661 (75.5%) |
| QuantMode on | 114243 | 114236 (100.0%) | 45687 | 45686 (100.0%) | 5704 | 5704 (100.0%) |
| (diff) | −16060 (−12.3%) | +54282 (+90.5%) | −6371 (−12.2%) | +17405 (+61.5%) | −469 (−7.6%) | +1043 (+22.4%) |

TABLE Ex3_4

| | Target PSMs | Quantifiable Target PSMs | Target Proteins | Quantifiable Target Proteins |
|---|---|---|---|---|
| Control | 7257 | 3041 | 1235 | 708 |
| 0% Threshold | 3261 | 3261 | 784 | 784 |
| 5% Threshold | 3935 | 3935 | 786 | 786 |
| 10% Threshold | 4474 | 4474 | 788 | 788 |
| 15% Threshold | 5076 | 5076 | 869 | 869 |
| 20% Threshold | 5789 | 5789 | 917 | 917 |
| 25% Threshold | 5988 (−25.5%) | 5988 (+84.5%) | 957 (−22.5%) | 957 (+35.2%) |
| 50% Threshold | 7330 | 3872 | 1197 | 793 |
| 75% Threshold | 7623 | 3318 | 1229 | 711 |
| 100% Threshold | 7068 | 2996 | 1136 | 642 |
| Infinite Threshold | 7080 | 2863 | 1203 | 646 |

EXAMPLE 4

Data Acquisition Method Enables Large-Scale Multiplexed Protein Quantification We describe a data acquisition method, the "QuantMode" algorithm (or "QuantMode"), which improves the dynamic range of isobaric label-based protein quantification. QuantMode alleviates the pervasive problem of precursor interference—co-isolation of impurities that skew quantification—by intelligent pre-acquisition instrument logic. Application to a shotgun experiment yielded large boosts in quantifiable PSMs (+91%), peptides (+65%), and proteins (+22%). We conclude QuantMode will render isobaric labeling a viable option for rapid, large-scale, multiplexed quantitative proteomics.

Protein identification technologies have rapidly matured such that constructing catalogs of the thousands of proteins comprised by a cell using mass spectrometry (MS) is now relatively straightforward [see de Godoy, L. M. F. et al. Nature 455, 1251-1255 (2008); and Swaney, D. L., Wenger, C. D. & Coon, J. J. J. Proteome Res. 9, 1323-1329 (2010)]. Knowing how the abundance of these molecules change under various circumstances is not [see Ong, S. E. & Mann, M. Nat. Chem. Biol. 1, 252-262 (2005)]. Stable isotope labeling by amino acids in cell culture (SILAC) provides a means to make binary or ternary comparisons [see Jiang, H. & English, A. M. J. Proteome Res. 1, 345-350 (2002); Ong, S. E. et al. Mol. Cell. Proteomics 1, 376-386 (2002); and Zhu, H. N., Pan, S. Q., Gu, S., Bradbury, E. M. & Chen, X. Rapid Commun. Mass Spectrom. 16, 2115-2123 (2002)]. By interlacing these two- or three-way experiments, higher-order comparisons can be obtained [see Olsen, J. V. et al. Sci. Signal. 3, -(2010)]. Such large-scale multiplexed experiments are invaluable as they (1) allow measurement of time-course experiments, (2) permit collection of biological replicates, and (3) enable direct comparison of transcriptomic and proteomic data.

Constructing this type of multi-faceted proteomics study, however, is an arduous undertaking and has only been accomplished in a handful of experiments by an even smaller group of researchers. The first impediment is the requirement to grow multiple groups of cells with various labels. Though laborious, this step is less limiting than the second major obstacle: each binary or ternary set must be analyzed separately. When combined with the extensive fractionation required prior to mass spectrometry and the need for technical replicates, a large-scale experiment via SILAC demands three to six months of constant instrument usage.

Isobaric labeling is an elegant solution to this problem introduced seven years ago [see Thompson, A. et al. Anal. Chem. 75, 1895-1904 (2003) and Ross, P. L. et al. Mol. Cell. Proteomics 3, 1154-1169 (2004)], allowing relative quantification of up to eight proteomes simultaneously [see Choe, L. et al. Proteomics 7, 3651-3660 (2007)]. Despite the potential to enable fast, multiplexed quantitative proteomics, isobaric labeling has not been widely embraced for large-scale studies [see Lu, R. et al. Nature 462, 358-U126 (2009)]. Precursor interference—the major drawback of this technique—is the central reason. This problem does not exist for SILAC because abundance measurements are performed in $MS^1$. Even for very complex samples having tens or hundreds of co-eluting peptides, high-resolving power mass analyzers can easily distinguish the target from neighboring peaks less than 0.01 Th away.

Figure 5:
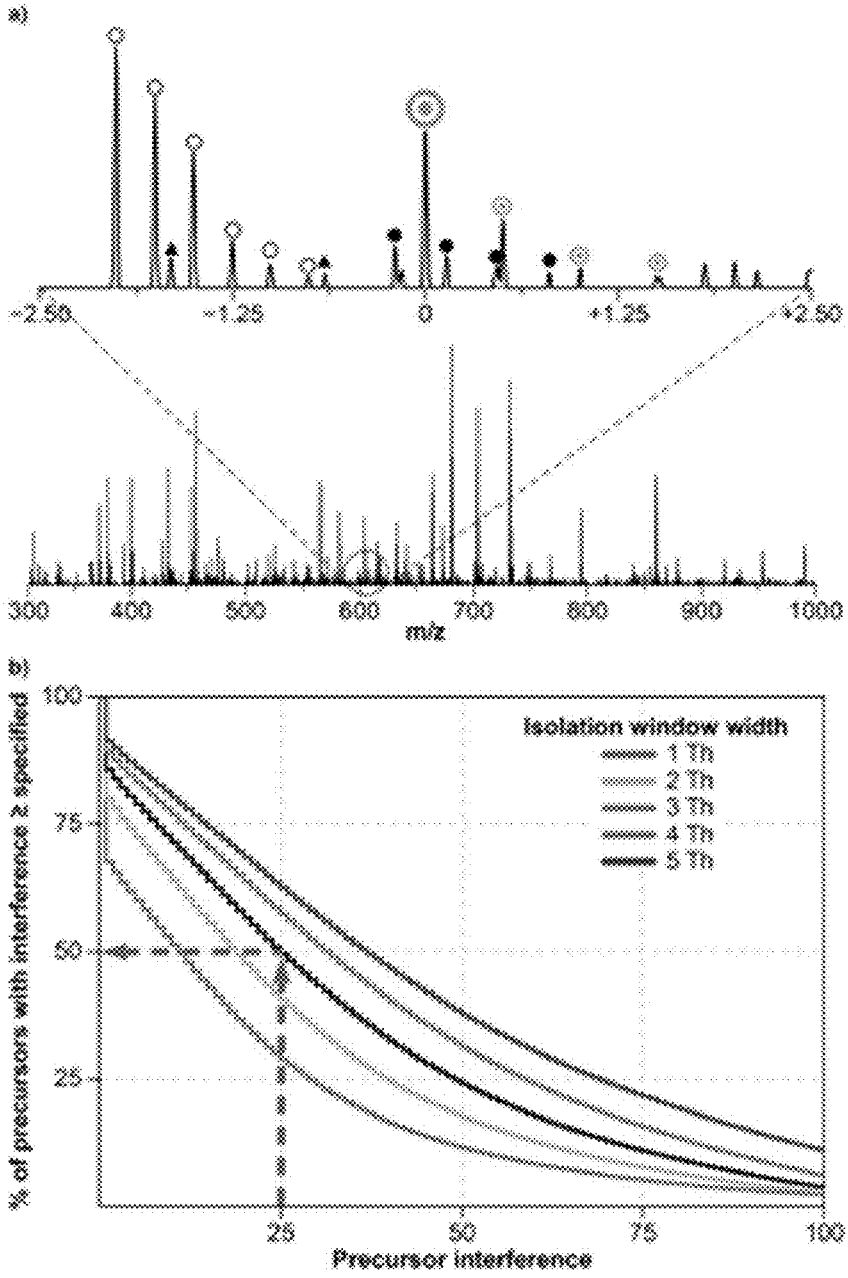
FIG. 5 provides plots showing precursor interference in LC-MS/MS. Panel (A) provides a plot showing an example of a precursor from a complex $MS^1$ scan with assorted interfering species. Panel (B) provides a plot showing interference levels for 130,303 precursors at various isolation window widths.

In the isobaric approach, however, the target peptide is isolated at much lower resolution, typically 1-3 Th, and fragmented to produce reporter tags. Therefore, the quantitative signal in the reporter region is compiled from every species in the isolation window [see Ow, S. Y. et al. J. Proteome Res. 8, 5347-5355 (2009)], as shown in FIG. 5, Panel (A). For highly complex mixtures, like those analyzed in large-scale experiments, co-isolation of multiple species is the rule, not the exception (vide infra). This problem erodes dynamic range, as measured ratios tend to be compressed toward the median ratio of 1:1 [see Karp, N. A. et al. Mol. Cell. Proteomics (2010)], and thus has restricted the technique to applications with lower sample complexity.

To document the extent of the precursor interference problem, we used the commercial iTRAQ 4-plex reagent to compare four cell lines: two human embryonic stem (ES) cell lines (H1 and H9), an induced pluripotent stem (iPS) cell line, and their fibroblast precursors. After tryptic digestion and labeling, the mixtures were combined, then separated into 19 pools by strong cation exchange (SCX) chromatography. Next, each fraction was analyzed by nanoHPLC-MS/MS. From these data we obtained 130,303 peptide-spectrum matches (PSMs) at a 1% false discovery rate (FDR). For each accepted PSM we examined the preceding $MS^1$ spectrum and tabulated the extent of precursor interference within various m/z windows. As depicted in FIG. 5, Panel (B), with the typical 3 Th window, approximately half of all identified precursors have interference greater than 25% (interference definition is given below). Narrowing the isolation window reduces the problem, but even at 1 Th, 30% of precursors still exceed this threshold.

With confirmation of the widespread occurrence of precursor interference, we next wondered to what extent does it degrade quantitative metrics? The standard strategy for validating quantitative proteomic techniques is to combine samples with different labels in known ratios. This approach, however, is not as informative for isobaric labeling, as interfering species generate the same abundance distribution as the target.

Instead, from the ES/IPS/fibroblast dataset, we extracted a set of "gold-standard" proteins. These 875 proteins were quantified with at least 5 PSMs and 3 unique peptides, all with less than 5% precursor interference. We assumed the protein quantification determined with these strict requirements was the true value. We then examined the effect of the addition of PSMs, with progressively higher levels of precursor interference, on the observed protein quantification for these "gold standards", as shown in FIG. 2, panel (A).

From these data, two distinct trends are apparent. First, the error bars expanding with increasing interference exhibit a reduction in quantitative precision. This observation holds true for both the entire set of 875 proteins (upper filled squares) and the subset of 101 proteins which change by 5-fold or greater (lower filled circles). Second is a drastic reduction in dynamic range. This trend is most apparent in the highly regulated subset, which exhibit nearly a 70% ratio error. In other words, a protein that is actually 5-fold upregulated will, on average, be measured as a mere 1.5-fold upregulation—a change that would not pass most filters. We conclude that precursor interference is both an extensive problem and a primary contributor to significant, wide-scale dampening of dynamic range for isobaric labeling.

With this information in hand, we reasoned that removing, or at least curtailing, the precursor interference problem in isobaric labeling would offer a direct route to rapid, large-scale, multiplexed protein quantification. Narrowing the precursor isolation width to 0.1 Th or lower could eliminate most interference; however, such high-resolution isolations are not routinely used. Reducing the width below ~2 Th can be problematic for LC-MS/MS experiments, as it causes low-level components to be inefficiently isolated due to space-charge effects. In lieu of narrower isolations, another obvious solution is post-data acquisition filtering. That is, by examining $MS^1$ spectra, precursors with high interference levels can be dismissed [see Zhang, Y. et al. Mol. Cell. Proteomics (2009)]. This solution, however, results in the loss of an unacceptably sizable portion of MS/MS spectra: ~50%, as shown in FIG. 5, Panel (B).

A more deliberate solution is to prevent the acquisition of tandem mass spectra that will not result in usable quantitative data. Doing so would free up time so that the mass spectrometer can sample other species, particularly those of lower abundance. To pursue this strategy, we implemented a real-time precursor purity check as an additional step in the data-dependent logic. We altered the instrument control code so that during the automated precursor selection process, candidate precursors with interference above a specified threshold are rejected until a suitable replacement is found. We call this acquisition technique QuantMode. In this way, the instrument shall never acquire an MS/MS spectrum having interference above the user-specified threshold.

Figure 6:
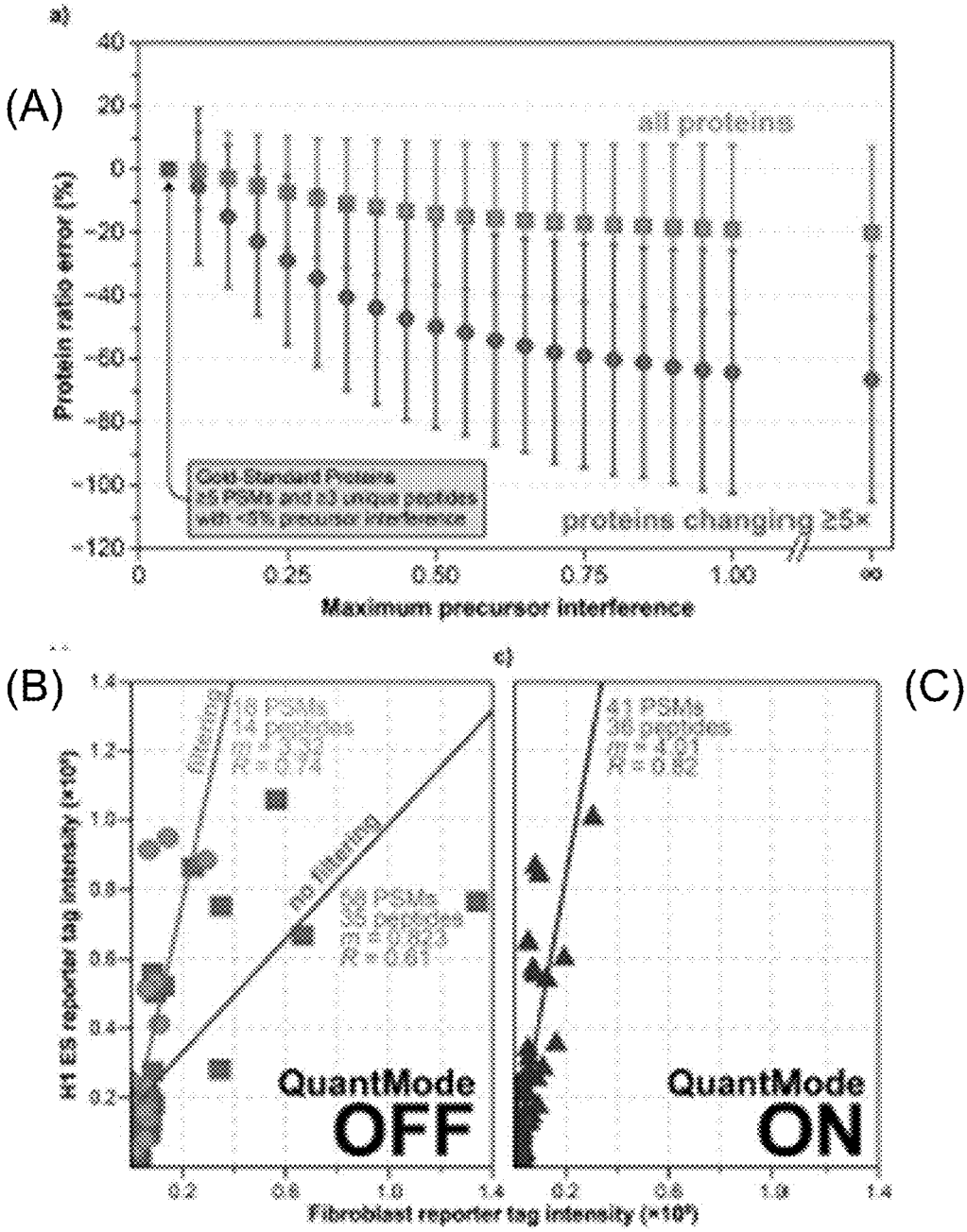
FIG. 6 provides plots showing the effects of precursor interference on protein quantification. Panel (A) provides a plot showing reduced dynamic range and precision as a function of precursor interference, as judged by comparison to "gold-standard" proteins with minimal interference and thus reliable quantification. Panels (B) and (C) provide plots showing a comparison of a single protein, condensin complex subunit 1, upregulated in ES cells, quantified without and with QuantMode, respectively.

An example, drawn from a shotgun experiment, of a single protein quantified with conventional data acquisition methods is provided in FIG. 6, Panel (B). This protein, condensin complex subunit 1, is required for chromosome condensation during mitosis and is upregulated during M phase [see Olsen, J. V. et al. Sci. Signal. 3, -(2010)]. ES cells proliferate more rapidly than fibroblast cells and are characterized by a higher percentage of cells in M phase [see Becker, K. A., Stein, J. L., Lian, J. B., Van Wijnen, A. J. & Stein, G. S. J. Cell. Physiol. 210, 517-526 (2007)]; thus, ES cells should exhibit higher expression levels of this protein. When quantified using a conventional acquisition method (rightward filled squares), however, the protein shows little difference in relative abundance between the two cell lines, exhibiting a slope (m) of 0.823-close to 1:1. The quantitative precision is also low, with a correlation coefficient (R) of 0.61. In contrast, when only PSMs for which the precursor has less than 25% interference are considered (leftward filled circles), a significant upregulation of 3.32-fold is seen. Filtering also improves precision, with the correlation coefficient increasing to 0.74. Unfortunately, this improved quantification comes at the expense of most of the protein's PSMs and peptides, as these numbers drop from 58 to 18 and 35 to 14, respectively.

Note that we define positive errors as those that make the observed protein ratio more extreme (e.g., 2:1→4:1 or 1:2→1:4), while negative errors are those that make the observed protein ratio less extreme (e.g., 4:1→2:1 or 1:4→1:2). In other words, positive protein ratio errors are those that get farther away from 1:1, while negative errors get closer to 1:1.

When this same protein is quantified with QuantMode enabled as shown in FIG. 6, Panel (C), filled triangles, a superior picture emerges. The slope, 4.01, is approximately the same as observed with post-acquisition filtering. Likewise, the correlation coefficient improved to 0.82, demonstrating good precision. However, the number of quantifiable PSMs and peptides is much more on par with those identified without QuantMode, at 41 and 36, respectively. Thus, with comparable results in terms of identification, QuantMode yields a substantial increase in the amount of quantifiable data over that obtained with conventional acquisition conditions. For all proteins quantified without and with QuantMode, 148% more PSMs and 91% more unique peptides were used when QuantMode was enabled.

Figure 7:
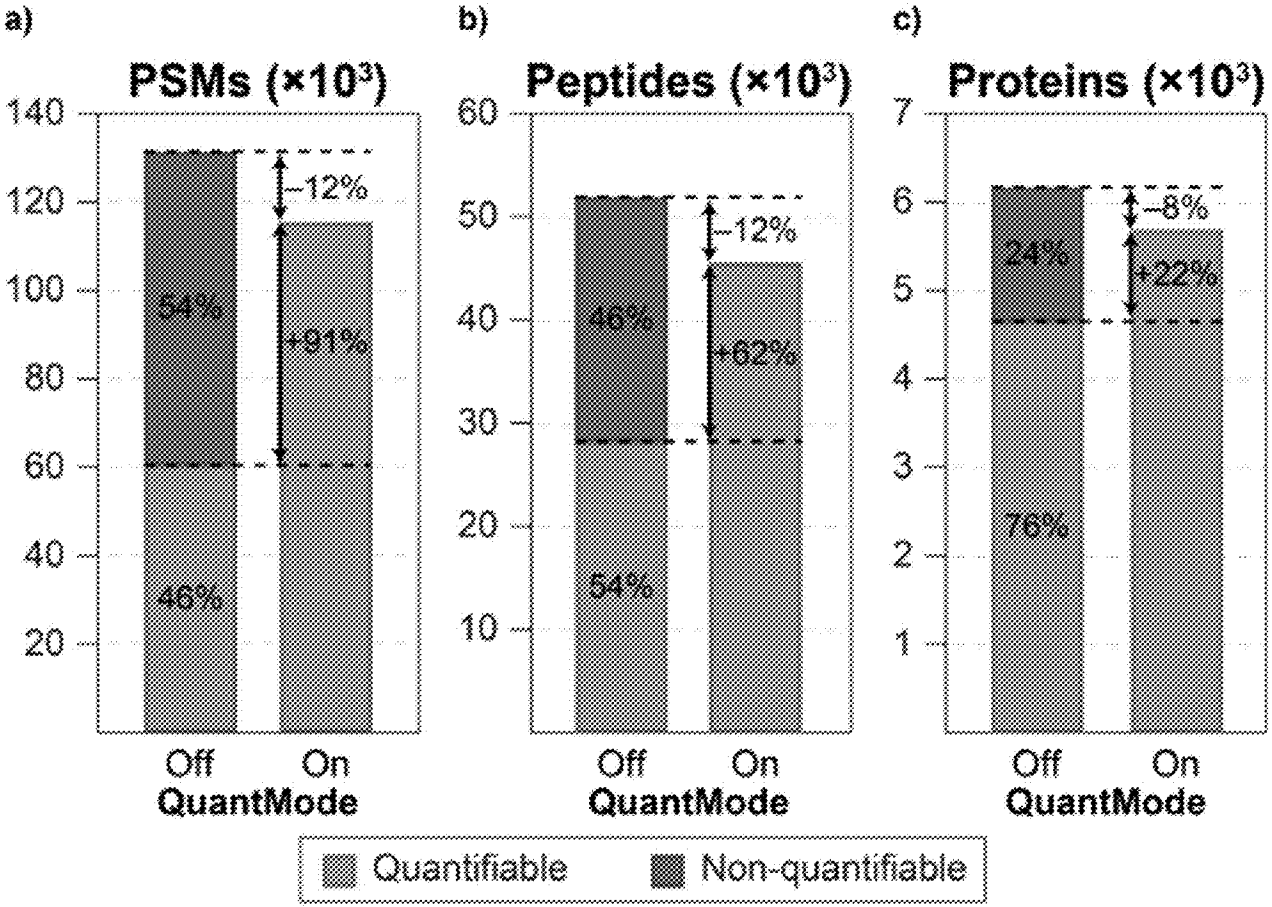
FIG. 7 provides plots showing the benefits of QuantMode. Panel (A) provides a plot showing PSMs identified and quantified without and with QuantMode for 19 LC-MS/MS analyses of SCX fractions. Panel (B) provides a plot showing peptides identified and quantified without and with QuantMode for 19 LC-MS/MS analyses of SCX fractions. Panel (C) provides a plot showing proteins identified and quantified without and with QuantMode for 19 LC-MS/MS analyses of SCX fractions. Although identifications drop slightly, quantifications increase considerably.
Figure 8:
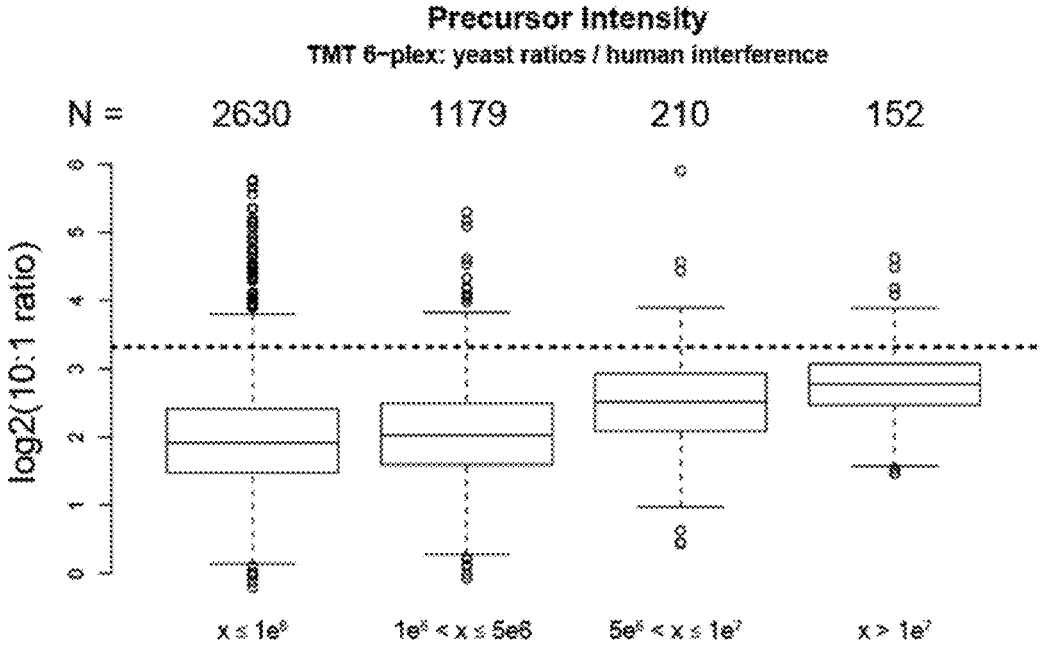
FIG. 8 provides measured isobaric tag ratios as a function of target precursor intensity (quantitative accuracy as a function of precursor intensity). Targets of high intensity provide ratios closest to the true value (dotted line) and may not require reducing interference. As precursor intensity increases, both the accuracy and precision of isobaric tag-based quantification improves. Compared to the expected 10:1 ratio, most precursors yield a quantitative ratio around 4:1. The most intense precursors (>10^7) give a much more accurate ratio, typically around 8:1.
Figure 9:
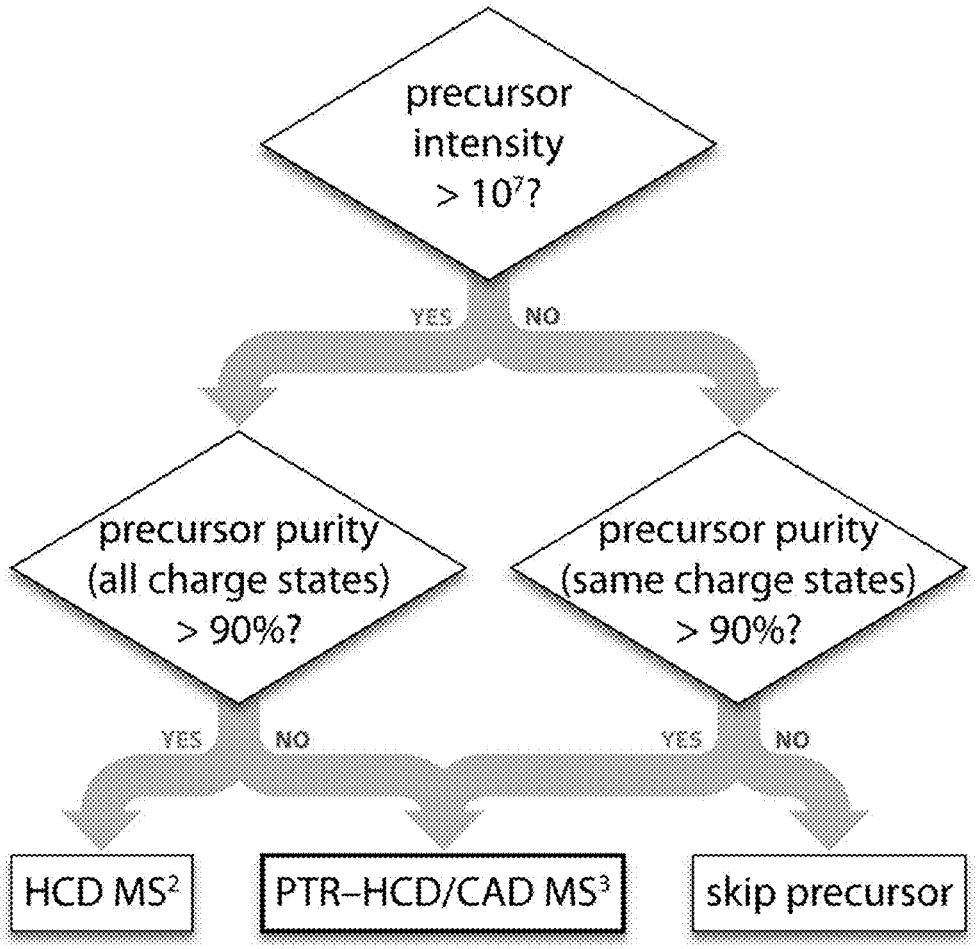
FIG. 9 provides a schematic diagram of an algorithm showing application of the analysis methods of the present invention (instrument firmware flowchart). In an embodiment, the algorithm works to not reduce interference of highly intense precursors because they already have good quantification: First, the precursor intensity is checked. If it is over $10^7$, its precursor purity is assessed (considering all charge states); If the purity is over 90%, the precursor will likely give good quantification without purification, and therefore is subjected to higher-energy collisional dissociation (HCD) $MS^2$; If the precursor purity is not sufficiently high, it is subjected to purification via proton transfer reaction higher-energy collisional dissociation followed by collision activated dissociation (PTR-HCD/CAD) $MS^3$ to yield reliable quantification; If the precursor intensity is not sufficiently high, its precursor purity is assessed, considering only peaks of the same charge state as the precursor; If this precursor purity is over 90%, it can likely be purified to yield good quantification and therefore is subjected to PTR-HCD/CAD $MS^3$; Otherwise, the precursor probably cannot be sufficiently purified, and is skipped entirely.
Figure 10:
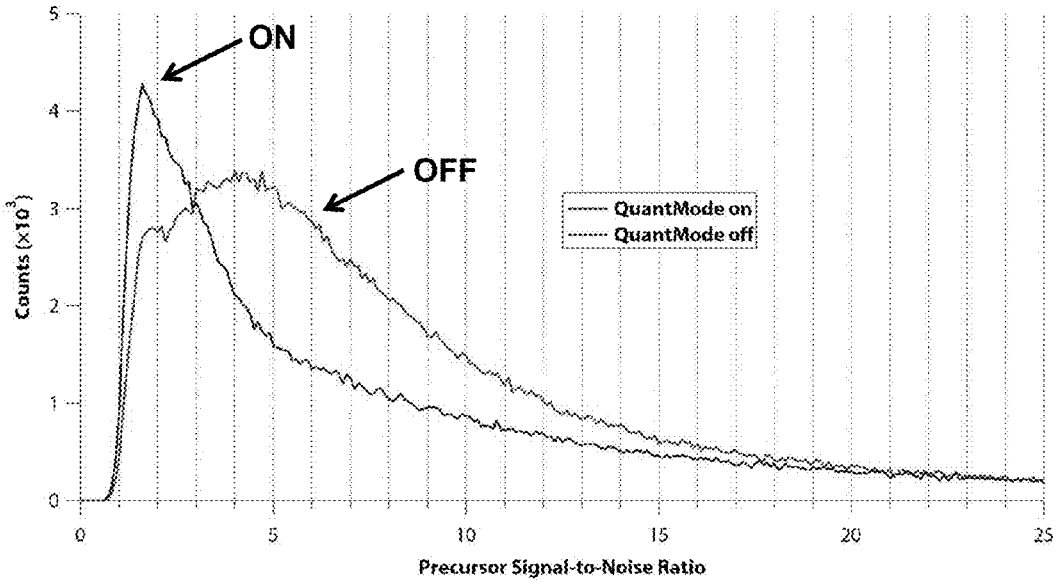

Upon LC-MS/MS analyses of the 19 SCX fractions from the human peptide mixture, each fraction analyzed consecutively without and with QuantMode, the benefits become evident, as shown in FIG. 7. Although identifications drop slightly (~10%), QuantMode yields significant gains in quantifiable PSMs (91%), peptides (+65%), and proteins (+22%). Much of these increases are derived from lower-abundance species, as shown in FIG. 10, which are more likely to go undetected with conventional acquisition approaches.

The significant increase in quantifiable identifications for these three metrics is critical to obtaining the fullest picture afforded by mass spectrometry-based quantitative proteomics. A higher number of PSMs equates to an increase in technical replicates, which are essential for obtaining statistical power. Because only a single peptide suffices to quantify a protein, the importance of more peptides contributing to higher sequence coverage may be overlooked. However, particularly in higher organisms, post-translational modifications (PTMs) play a key role in the regulation of biochemical processes. Higher sequence coverage reduces the likelihood that these PTMs have skewed quantitation. Observing more peptides—such that a greater proportion are unmodified—means that the quantification obtained is more likely to represent the protein overall. Finally, increasing the number of quantifiable proteins, especially those occurring at lower abundance, is clearly important for improved proteome coverage.

In summary, we demonstrate that isobaric labeling methods suffer from systemic loss of precision and dynamic range due to the inherent problem of precursor interference. We described a new data acquisition method, QuantMode, which mitigates this problem by dynamically examining $MS^1$ scans for the presence of interfering species. Application of the method to a shotgun experiment yielded large boosts in quantifiable PSMs, peptides, and proteins. We conclude this approach will render isobaric labeling a viable option for rapid, accurate, large-scale, multiplexed protein quantification.

Sample Preparation

Human embryonic stem cells (lines H1 and H9) and induced pluripotent stem cells (line DF-19-9-7T, see Yu, J. Y. et al. Science 324, 797-801 (2009)) were maintained in a feeder-independent system, as previously described [see Ludwig, T. E. et al. Nat. Methods 3, 637-646 (2006)]. Human newborn foreskin fibroblasts (Cat# CRL-2097™, ATCC) were cultured essentially according to ATCC recommendations. All cells were harvested by individualizing for 10 minutes with an adequate volume of pre-warmed (37° C.), 0.05% Tryp-LE to cover the culture surface. Following cell detachment, an equivalent volume of either ice-cold DPBS (Invitrogen), in the case of ES cells, or ice-cold growth media, in the case of fibroblast cells, was added before collecting the cells. Cell pellets were subsequently washed twice in ice-cold PBS and stored at −80° C. Approximately 108 cells were collected for each analysis.

Samples were lysed via sonication in lysis buffer containing 40 mM NaCl, 50 mM tris, 2 mM mgCl2, 50 mM NaF, 50 mM b-glyceraldehyde phosphate, 1 mM sodium orthovanadate, 10 mM sodium pyrophosphate, 1 mini EDTA-free protease inhibitor (Roche Diagnostics), and 1 phosSTOP phosphatase inhibitor (Roche Diagnostics).

Cysteine residues were reduced with DTT, alkylated using iodoacetamide, and digested in a two-step process. Proteinase Lys-C (Wako Chemicals) was added at an enzyme:protein ratio of 1:100 and incubated for approximately 2 hours at 37° C. in lysis buffer. Samples were then diluted with 50 mM tris (pH 8.0) until the urea concentration was 1.5 M and digested with trypsin (Promega) at an enzyme:protein ratio of 1:50 at 37° C. overnight. Reactions were quenched using trifluoroacetic acid (TFA). Samples were dried to completion and purified using C18 solid-phase extraction (SPE) columns (SepPak, Waters). iTRAQ labeling was performed according to manufacturer-supplied protocols and mixed.

Fractionation

The labeled peptides were resuspended in SCX buffer A and injected onto a polysulfoethyl aspartamide column (9.4× 200 mm; PolyLC). Separations were performed using a Surveyor LC quaternary pump (Thermo Scientific) at a flow rate of 3.0 mL/min. The following gradient was used for separation: 0-2 min, 100% buffer A; 2-5 min, 0-15% buffer B; 5-35 min, 15-100% buffer B. Buffer B was held at 100% for 10 minutes. Finally, the column was washed extensively with buffer C and water prior to recalibration. The following buffers were used: buffer A—5 mM KH2PO4, 30% acetonitrile (pH 2.65); buffer B—5 mM KH2PO4, 30% acetonitrile, 350 mM KCl (pH 2.65); buffer C—50 mM KH2PO4, 500 mM KCl (pH 7.5). Samples were collected by hand and desalted by SPE.

Liquid chromatography-mass spectrometry. Online chromatography was performed with a NanoAcquity HPLC system (Waters) coupled to an LTQ Orbitrap Velos (Thermo Scientific). Samples were loaded onto a precolumn (75 μm i.d., packed with 5 cm C18 particles, Alltech) for 10 min at a flow rate of 1 μm/min. Samples were then eluted over an analytical column (50 μm i.d., packed with 15 cm C18 particles, Alltech) using a 120 min linear gradient from 1% to 35% acetonitrile with 0.2% formic acid and a flow rate of 300 nL/min. An additional 30 min were used for column washing and equilibration. The column-making procedure was previously described [see Martin, S. E., Shabanowitz, J., Hunt, D. F. & Marto, J. A. Anal. Chem. 72, 4266-4274 (2000)].

SCX fractions were analyzed with QuantMode disabled, then enabled, in alternating fashion. The instrument method was a 146-minute data-dependent top-10 experiment consisting of a 30,000 resolution $MS^1$ scan and 7,500 resolution HCD $MS^2$ scans, all detected in the orbitrap. Automatic gain control (AGC) targets were 1,000,000 for FT MS1 and 50,000 for FT MSn. An isolation window of 3 Th was used for MS/MS. Precursors of unknown or +1 charge state were excluded. Dynamic exclusion was enabled for 60 s after one fragmentation event. Raw data will be deposited in the Tranche online repository for public accessibility upon acceptance of the manuscript.

The QuantMode algorithm for determining interference on the fly consisted of iterating through all peaks within a window around the precursor. The window was enlarged by 20% relative to the actual isolation window, from 3 Th to 3.6 Th, to account for the empirical observation that species outside the isolation window (particularly on the low m/z side) could still be retained at significant levels. The peak m/z was converted to mass and compared to the precursor mass, assuming both species had the same charge. The nearest multiple of 1.00335 Da (carbon-13 mass minus carbon-12 mass, the main contributor to peptide isotopic peaks) was subtracted, and the remaining mass error was converted to parts per million (ppm). If the mass error was less than ±25 ppm, the peak was judged as a precursor peak and its intensity was compared against the current most intense precursor. Otherwise, the peak was judged as an interference peak and its intensity was compared against the current most intense interference. Once all peaks were considered, precursor interference was calculated as the most intense interference peak intensity divided by the most intense precursor peak intensity.

We note that the QuantMode algorithm could be readily implemented using the LTQ COM library [see Wenger, C. D., Boyne, M. T., Ferguson, J. T., Robinson, D. E. & Kelleher, N. L. Anal. Chem. 80, 8055-8063 (2008)] provided by Thermo, or similar resources offered by other instrument vendors. Pseudocode for the algorithm is as follows:

```
// performed for each candidate precursor
if quant_mode is enabled
precursor_impurity = DeterminePrecursorImpurity(precursor_mz,
precursor_charge);
if precursor_impurity > precursor_impurity_threshold
exclude precursor;
function DeterminePrecusorImpurity(precursorMZ, precursorCharge)
precursor_mass = precursorMZ * precursorCharge − precursorCharge *
PROTON_MASS;
half_isolation_window = 0.5 * isolation_window;
low_mz = precursorMZ − half_isolation_window;
high_mz = precursorMZ + half_isolation_window;
max_precursor_intensity = 0.0;
max_interference_intensity = 0.0;
for each peak in peaks between low_mz and high_mz
mass_difference = (peak_mz − precursorMZ) * precursor_charge;
adjusted_mass_difference = mass_difference − Round(mass_difference /
C12_C13_MASS_DIFF) * C12_C13_MASS_DIFF;
adjusted_mass_difference_ppm = adjusted_mass_difference /
precursor_mass * 1000000;
if AbsoluteValue(adjusted_mass_difference_ppm) <= mass_tolerance_ppm
if peak_intensity > max_precursor_intensity
max_precursor_intensity = peak_intensity;
else
if peak_intensity > max_interference_intensity
max_interference_intensity = peak_intensity;
return max_interference_intensity / max_precursor_intensity;
```

Data Analysis

The resulting mass spectra were processed with the COMPASS software suite [see Wenger C D, Phanstiel D H, Lee M V, Bailey D J, Coon J J. COMPASS: A suite of pre- and post-search proteomics software tools for OMSSA. Proteomics. 2011 March; 11(6):1064-74]. OMSSA [see Geer, L. Y. et al. J. Proteome Res. 3, 958-964 (2004)] searches were done against a concatenated target-decoy [see Elias, J. E. & Gygi, S. P. Nat. Methods 4, 207-214 (2007)] version of the human International Protein Index [see Kersey, P. J. et al. Proteomics 4, 1985-1988 (2004)] database (version 3.67) using an average precursor mass tolerance of ±5.0 Da and a monoisotopic product mass tolerance of ±0.01 Da. Carbamidomethylation of cysteines (+57 Da) and iTRAQ 4-plex on peptide N-terminii and lysines (+145 Da) were specified as fixed modifications, while oxidation of methionine (+16 Da) and iTRAQ 4-plex on tyrosines (+145 Da) were specified as variable modifications. Post-data acquisition interference filtering was performed using the same algorithm described above for on-the-fly filtering.

Although the description herein contains many specifics, these should not be construed as limiting the scope of the invention, but as merely providing illustrations of some of the embodiments of the invention.

Statements Regarding Incorporation By Reference And Variations

Each reference cited herein is hereby incorporated by reference in its entirety. However, if any inconsistency arises between a cited reference and the present disclosure, the present disclosure takes precedent. Some references provided herein are incorporated by reference to provide details concerning the state of the art prior to the filing of this application, other references can be cited to provide additional or alternative device elements, additional or alternative materials, additional or alternative methods of analysis or applications of the invention. Patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, methods steps set forth in the present description. As will be obvious to one of skill in the art, methods and devices useful for the present methods can include a large number of optional composition and processing elements and steps.

One of ordinary skill in the art will appreciate that device elements, as well as materials, shapes and dimensions of device elements, as well as methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed can be resorted to by those skilled in the art, and that such modifications and variations are considered to be within the scope of this invention.

When a Markush group or other grouping is used herein, all individual members of the group and all combinations and possible subcombinations of the group are intended to be individually included in the disclosure. Every combination of components or materials described or exemplified herein can be used to practice the invention, unless otherwise stated. One of ordinary skill in the art will appreciate that methods, device elements, and materials other than those specifically exemplified can be employed in the practice of the invention without resort to undue experimentation. All art-known functional equivalents, of any such methods, device elements, and materials are intended to be included in this invention. Whenever a range is given in the specification, for example, a temperature range, a frequency range, a time range, or a composition range, all intermediate ranges and all subranges, as well as, all individual values included in the ranges given are intended to be included in the disclosure. Any one or more individual members of a range or group disclosed herein can be excluded from a claim of this invention. The invention illustratively described herein suitably can be practiced in the absence of any element or elements, limitation or limitations which is not specifically disclosed herein.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. The term "comprising" is intended to be broader than the terms "consisting essentially of" and "consisting of", however, the term "comprising" as used herein in its broadest sense is intended to encompass the narrower terms "consisting essentially of" and "consisting of", thus the term "comprising" can be replaced with "consisting essentially of" to exclude steps that do not materially affect the basic and novel characteristics of the claims and "comprising" can be replaced with "consisting of" to exclude not recited claim elements.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed can be resorted to by those skilled in the art, and that such modifications and variations are considered to be within the scope of this invention as defined by the appended claims.

Although the description herein contains many specifics, these should not be construed as limiting the scope of the invention, but as merely providing illustrations of some of the embodiments of the invention.

What is claimed is:

1. A method of analyzing an analyte using mass spectrometry, the method comprising:

(a) providing an analyte;

(b) generating a distribution of precursor ions from the analyte;

(c) analyzing the mass-to-charge ratios of at least a portion of the distribution of precursor ions, thereby generating precursor ion mass spectrometry data corresponding to the distribution of precursor ions;

(d) identifying a precursor peak in the precursor ion mass spectrometry data corresponding to a precursor ion;

(e) fragmenting ions corresponding to a preselected range of m/z units about the precursor peak, wherein the preselected range is within 0.01 to 10 m/z units of the precursor peak, thereby generating fragment ions;

(f) measuring the mass-to-charge ratios of the fragment ions, thereby generating product ion mass spectrometry data;

(g) determining the amount of interference within the preselected range of m/z units about the precursor peak; and (h) analyzing the precursor ion mass spectrometry data and the product ion mass spectrometry data for which the amount of interference is less than a selected value, and not analyzing the precursor ion mass spectrometry data and the product ion mass spectrometry data for which the amount of interference is greater than or equal to the selected value;

thereby analyzing the analyte using mass spectrometry.

2. A method of analyzing an analyte using mass spectrometry, the method comprising:

(a) providing an analyte;

(b) generating a distribution of precursor ions from the analyte;

(c) analyzing the mass-to-charge ratios of at least a portion of the distribution of precursor ions, thereby generating precursor ion mass spectrometry data corresponding to the distribution of precursor ions;

(d) identifying a precursor peak in the precursor ion mass spectrometry data corresponding to a precursor ion;

(e) determining the amount of interference within a preselected range of m/z units about the precursor peak, wherein the preselected range is within 0.01 to 10 m/z units of the precursor peak;

(f) fragmenting ions corresponding to the preselected range of m/z units about the precursor peak when the amount of interference is less than a selected value, thereby generating fragment ions; and not fragmenting ions corresponding to the preselected range of m/z units about the precursor peak when the amount of interference is greater than or equal to the selected value;

(g) measuring the mass-to-charge ratios of the fragment ions, thereby generating product ion mass spectrometry data; and (h) analyzing the precursor ion mass spectrometry data and the product ion mass spectrometry data;

thereby analyzing the analyte using mass spectrometry.

3. A method of analyzing an analyte using mass spectrometry, the method comprising:

(a) providing an analyte;

(b) generating a distribution of precursor ions from the analyte;

(c) analyzing the mass-to-charge ratios of at least a portion of the distribution of precursor ions, thereby generating precursor ion mass spectrometry data corresponding to the distribution of precursor ions;

(d) identifying a precursor peak in the precursor ion mass spectrometry data corresponding to a precursor ion;

(e) determining the amount of interference within a preselected range of m/z units about the precursor peak, wherein the preselected range is within 0.01 to 10 m/z units of the precursor peak;

(f) fragmenting ions corresponding to the preselected range, thereby generating fragment ions;

(g) measuring mass-to-charge ratios of fragment ions corresponding to a preselected range when the amount of interference is less than a selected value, and not measuring mass-to-charge ratios of fragment ions corresponding to a preselected range when the amount of interference is greater than or equal to the selected value, thereby generating product ion mass spectrometry data; and (h) analyzing the precursor ion mass spectrometry data and the product ion mass spectrometry data;

thereby analyzing the analyte using mass spectrometry.

4. A mass spectrometer system for analyzing an analyte, the system comprising:

an ion source for generating ions from the analyte;

first ion separation optics in communication with the ion source for separating ions according to their mass-to-charge ratios;

a first ion detector in communication with the first ion separation optics for detecting ions separated according to their mass-to-charge ratios;

ion fragmentation optics in communication with the first ion separation optics for generating fragment ions;

second ion separation optics in communication with the ion fragmentation optics for separating ions according to their mass-to-charge ratios;

a second ion detector in communication with the second ion separation optics for detecting ions separated according to their mass-to-charge ratios;

a controller operably connected to the first and second ion separation optics, the first and second ion detectors, and the ion fragmentation optics;

wherein the controller controls the ion optics and detectors so as to:

(a) generate a distribution of precursor ions from the analyte;

(b) analyze the mass-to-charge ratios of at least a portion of the distribution of precursor ions, thereby generating precursor ion mass spectrometry data corresponding to the distribution of precursor ions;

(c) identify a precursor peak in the precursor ion mass spectrometry data corresponding to a precursor ion;

(d) determine the amount of interference within a preselected range of m/z units about the precursor peak, wherein the preselected range is within 0.01 to 10 m/z units of the precursor peak;

(e) fragment the ions corresponding to the preselected range, thereby generating fragment ions;

(f) measure mass-to-charge ratios of fragment ions corresponding to a preselected range when the amount of interference is less than a selected value, and not measure mass-to-charge ratios of fragment ions corresponding to a preselected range when the amount of interference is greater than or equal to the selected value, thereby generating product ion mass spectrometry data; and (g) analyze the precursor ion mass spectrometry data and the product ion mass spectrometry data.

5. A mass spectrometer system for analyzing an analyte, the system comprising:

an ion source for generating ions from the analyte;

first ion separation optics in communication with the ion source for separating ions according to their mass-to-charge ratios;

a first ion detector in communication with the first ion separation optics for detecting ions separated according to their mass-to-charge ratios;

ion fragmentation optics in communication with the first ion separation optics for generating fragment ions;

second ion separation optics in communication with the ion fragmentation optics for separating ions according to their mass-to-charge ratios;

a second ion detector in communication with the second ion separation optics for detecting ions separated according to their mass-to-charge ratios;

a controller operably connected to the first and second ion separation optics, the first and second ion detectors, and the ion fragmentation optics;

wherein the controller controls the ion optics and detectors so as to:

(a) generate a distribution of precursor ions from the analyte;

(b) analyze the mass-to-charge ratios of at least a portion of the distribution of precursor ions, thereby generating precursor ion mass spectrometry data corresponding to the distribution of precursor ions;

(c) identify a precursor peak in the precursor ion mass spectrometry data corresponding to a precursor ion;

(d) fragment ions corresponding to a preselected range of m/z units about the precursor peak, wherein the preselected range is within 0.01 to 10 m/z units of the precursor peak, thereby generating fragment ions;

(e) measure the mass-to-charge ratios of the fragment ions, thereby generating product ion mass spectrometry data;

(f) determine the amount of interference within the preselected range of m/z units about the precursor peak; and (g) analyze the precursor ion mass spectrometry data and the product ion mass spectrometry data for which the amount of interference is less than a selected value, and not analyze the precursor ion mass spectrometry data and the product ion mass spectrometry data for which the amount of interference is greater than or equal to the selected value.

6. A mass spectrometer system for analyzing an analyte, the system comprising:

an ion source for generating ions from the analyte;

first ion separation optics in communication with the ion source for separating ions according to their mass-to-charge ratios;

a first ion detector in communication with the first ion separation optics for detecting ions separated according to their mass-to-charge ratios;

ion fragmentation optics in communication with the first ion separation optics for generating fragment ions;

second ion separation optics in communication with the ion fragmentation optics for separating ions according to their mass-to-charge ratios;

a second ion detector in communication with the second ion separation optics for detecting ions separated according to their mass-to-charge ratios;

a controller operably connected to the first and second ion separation optics, the first and second ion detectors, and the ion fragmentation optics;

wherein the controller controls the ion optics and detectors so as to:

(a) generate a distribution of precursor ions from the analyte;

(b) analyze the mass-to-charge ratios of at least a portion of the distribution of precursor ions, thereby generating precursor ion mass spectrometry data corresponding to the distribution of precursor ions;

(c) identify a precursor peak in the precursor ion mass spectrometry data corresponding to a precursor ion;

(d) determine the amount of interference within a preselected range of m/z units about the precursor peak, wherein the preselected range is within 0.01 to 10 m/z units of the precursor peak;

(e) fragment ions corresponding to the preselected range when the amount of interference is less than a selected value, thereby generating fragment ions; and not fragment ions corresponding to the preselected range when the amount of interference is greater than or equal to the selected value;

(f) measure mass-to-charge ratios of the fragment ions, thereby generating product ion mass spectrometry data; and (g) analyze the precursor ion mass spectrometry data and the product ion mass spectrometry data.

7. A method of analyzing an analyte using mass spectrometry, the method comprising:

(a) providing an analyte;

(b) generating a distribution of precursor ions from the analyte;

(c) analyzing the mass-to-charge ratios of at least a portion of the distribution of precursor ions, thereby generating precursor ion mass spectrometry data corresponding to the distribution of precursor ions;

(d) identifying a precursor peak in the precursor ion mass spectrometry data corresponding to a precursor ion;

(e) determining an amount of interference within a range of 0.01 to 10 m/z units of the precursor peak;

(f) adjusting the range of m/z units such that the amount of interference is less than a selected value; and (g) analyzing the ions within the adjusted range of m/z units;

thereby analyzing the analyte using mass spectrometry.

8. The method of claim 7, wherein adjusting the range of m/z units such that the amount of interference is less than a selected value comprises:

(i) identifying a largest intensity precursor peak within the range of m/z units;

(ii) identifying an interference peak at lowest m/z within the range of m/z units of intensity greater than or equal to 25% of the intensity of the of the largest intensity precursor peak;

(iii) identifying an interference peak at highest m/z within the range of m/z units of intensity greater than or equal to 25% of the intensity of the of the largest intensity precursor peak;

(iv) identifying an m/z unit midpoint between the interference peak at lowest m/z and the interference peak at highest m/z; and (v) selecting the range of m/z units to be 75% of an m/z difference between the interference peak at lowest m/z and the interference peak at highest m/z centered on the m/z unit midpoint.

9. The method of claim 7, wherein adjusting the range of m/z units such that the amount of interference is less than a selected value comprises:

(i) setting the range of m/z units to be within 10 m/z of the precursor peak;

(ii) determining the amount of interference within the range of m/z units of the precursor peak; and (iii) reducing the range of m/z units by 1 m/z if the amount of interference within the range of m/z units is greater than or equal to the selected value.

10. The method of claim 7, wherein adjusting the range of m/z units such that the amount of interference is less than a selected value comprises:

(i) setting the range of m/z units to be within 10 m/z of the precursor peak;

(ii) determining the amount of interference within the range of m/z units of the precursor peak; and (iii) reducing the range of m/z units by 0.1 m/z if the amount of interference within the range of m/z units is greater than or equal to the selected value.

11. The method of claim 7, wherein adjusting the range of m/z units such that the amount of interference is less than a selected value comprises:

(i) setting the range of m/z units to be within 10 m/z of the precursor peak;

(ii) determining the amount of interference within the range of m/z units of the precursor peak; and (iii) reducing the range of m/z units by 0.01 m/z if the amount of interference within the range of m/z units is greater than or equal to the selected value.

12. The method of claim 7, further comprising:

(h) fragmenting the ions corresponding to the precursor peak, thereby generating fragment ions;

(i) measuring the mass-to-charge ratios of the fragment ions, thereby generating product ion mass spectrometry data; and (j) analyzing the precursor ion mass spectrometry data and the product ion mass spectrometry data for which the amount of interference is less than the selected value, and not analyzing the precursor ion mass spectrometry data and the product ion mass spectrometry data for which the amount of interference is greater than or equal to the selected value.

13. The method of claim 7, further comprising:

(h) fragmenting the ions corresponding to the precursor peak, provided the amount of interference is less than the selected value, thereby generating fragment ions; and not fragmenting the ions corresponding to the precursor peak, provided the amount of interference is greater than or equal to the selected value;

(i) measuring the mass-to-charge ratios of the fragment ions, thereby generating product ion mass spectrometry data; and (j) analyzing the precursor ion mass spectrometry data and the product ion mass spectrometry data.

14. The method of claim 12, wherein the precursor ion mass spectrometry data and product ion mass spectrometry data are only analyzed for precursor ion mass spectrometry data and product ion mass spectrometry data indicative of a single species of precursor.

15. The method of claim 13, wherein the precursor ion mass spectrometry data and product ion mass spectrometry data are only analyzed for precursor ion mass spectrometry data and product ion mass spectrometry data indicative of a single species of precursor.

16. The method of claim 7, wherein the amount of interference is determined by calculation of an interference ratio and the selected value is an interference ratio less than or equal to 0.5.

17. The method of claim 7, wherein the amount of interference is determined by calculation of an interference ratio of a largest interference peak intensity within the range of m/z units to a largest precursor peak intensity within the range of m/z units.

18. The method of claim 7, wherein the amount of interference is determined by calculation of an interference ratio of the sum of all interference peak intensities within the range of m/z units to the sum of all precursor peak intensities within the range of m/z units.

19. The method of claim 17, wherein only peaks having intensity greater than or equal to 10% of the most intense precursor ion peak in the precursor ion mass spectrometry data are considered.

20. The method of claim 18, wherein only peaks having intensity greater than or equal to 10% of the most intense precursor ion peak in the precursor ion mass spectrometry data are considered.

21. The method of claim 17, wherein only peaks having a signal-to-noise ratio greater than 2-to-1 are considered.

22. The method of claim 18, wherein only peaks having a signal-to-noise ratio greater than 2-to-1 are considered.

23. The method of claim 17, wherein only peaks having an isotopic abundance pattern indicative of an ionic species are considered.

24. The method of claim 18, wherein only peaks having an isotopic abundance pattern indicative of an ionic species are considered.

25. The method of claim 7, wherein the range of m/z units is 0.01 to 5 m/z units.

26. The method of claim 7, wherein adjusting the range of m/z units such that the amount of interference is less than a selected value comprises:

(i) measuring a signal-to-noise ratio of the precursor peak;

(ii) adjusting the range of m/z units if the signal-to-noise ratio is less than 3-to-1; and not adjusting the range of m/z units if the signal-to-noise ratio is greater than or equal to 3-to-1.

* * * * *